US012600446B2

(12) United States Patent
Caspall

(10) Patent No.: US 12,600,446 B2
(45) Date of Patent: Apr. 14, 2026

(54) DEVICES AND SYSTEMS FOR MOUNTING A TRANSDUCER WITHIN A WATERCRAFT HULL

(71) Applicant: Navico, Inc., Tulsa, OK (US)

(72) Inventor: Jayme J. Caspall, Tulsa, OK (US)

(73) Assignee: Navico, Inc., Tulsa, OK (US)

( * ) Notice: Subject to any disclaimer, the term of this patent is extended or adjusted under 35 U.S.C. 154(b) by 505 days.

(21) Appl. No.: 18/358,988

(22) Filed: Jul. 26, 2023

(65) Prior Publication Data

US 2025/0033747 A1 Jan. 30, 2025

(51) Int. Cl.
*B63B 79/10* (2020.01)
*B63B 17/00* (2006.01)

(52) U.S. Cl.
CPC ..... *B63B 79/10* (2020.01); *B63B 17/00* (2013.01); *B63B 2017/0054* (2013.01)

(58) Field of Classification Search
CPC ..... B63B 79/00; B63B 79/10; B63B 17/00; B63B 2017/0054; B63B 2201/00; B63B 2201/02; G10K 11/004; G10K 11/006
USPC ..... 114/343; 367/140, 141, 157, 165, 166, 367/171
See application file for complete search history.

(56) References Cited

U.S. PATENT DOCUMENTS 3,989,213 A * 11/1976 Allen ..... G10K 11/004 248/214
4,811,310 A * 3/1989 Wille ..... G10K 11/006 367/173
5,016,225 A * 5/1991 Blomberg ..... G10K 11/006 248/205.5
5,142,497 A 8/1992 Warrow
5,529,272 A * 6/1996 Baublitz, Sr. ..... F16M 13/022 248/231.71
6,019,333 A * 2/2000 Waller ..... B63B 49/00 248/295.11
6,928,940 B2 * 8/2005 Soun ..... A01C 7/122 111/178
8,947,979 B2 * 2/2015 Johnson ..... B63B 17/00 367/173
9,145,192 B1 * 9/2015 Albin ..... G01S 7/521
11,846,734 B2 * 12/2023 Hughes ..... G01S 7/521

* cited by examiner

*Primary Examiner* — Daniel V Venne
(74) *Attorney, Agent, or Firm* — Nelson Mullins Riley & Scarborough LLP

(57) ABSTRACT

Example devices and systems are provided herein for mounting a transducer within a hull of a watercraft. Such devices and systems include a housing with a base and at least one wall defining an interior volume, along with a mount assembly within the interior volume. The mount assembly includes a buoy, a transducer, and a pivot axle or a gimbal. The mount assembly is freely pivotable about a pivot axis of the pivot axle or about a pivot point of the gimbal such that an orientation of the mount assembly is subject to a force of gravity. The housing and the mount assembly is configured such that an emitting face of the transducer points in a direction that is parallel to the force of gravity when the housing is tilted, such as toward a floor of the water.

21 Claims, 11 Drawing Sheets

DEVICES AND SYSTEMS FOR MOUNTING A TRANSDUCER WITHIN A WATERCRAFT HULL

FIELD OF THE INVENTION

Example embodiments of the present invention generally relate to watercrafts and, more particularly to, devices and systems for mounting a transducer within a hull of a watercraft.

BACKGROUND

A hull of a watercraft generally defines a deadrise, which is an angle formed between the horizontal and the hull of the watercraft. Current assemblies used to install transducers in through-hole configurations in hulls of watercrafts are dependent on the deadrise values of the hulls in which the assemblies are installed. That is, different assemblies are required for installations in watercrafts with hulls having different angles with respect to the horizontal. This is so that an emitting face of the transducer can remain at a zero angle with respect to the horizontal, such that the transducer can capture a directly downward view of the underwater environment, while the mounting assembly itself is flush with the angled surface of the hull. Because different mounting assemblies are currently required for through-hole installations in hulls with different deadrises, there is a need for a mounting assembly that can maintain a downward emitting direction of the transducer at any hull deadrise.

BRIEF SUMMARY

Example embodiments provide various devices and systems for mounting a transducer within a hull of a watercraft. The devices and systems disclosed herein are configured to automatically adjust an orientation of a transducer such that it faces a floor of a body of water underneath the watercraft no matter the hull deadrise of the watercraft in which the transducer is mounted. This is useful at least because the devices and systems do not have to be altered or replaced for different hull deadrises. Moreover, the devices and systems are also useful in maintaining the orientation of the transducer in a watercraft having any hull deadrise and further when the watercraft is subject to external forces. That is, because of the way that the devices and systems herein mount a transducer within a through-hole of a hull of a watercraft, the transducer may, in some embodiments, maintain its downward facing orientation no matter how the hull rotates within the water (e.g., due to waves or other forces).

In some embodiments, a device may include a housing with a base and at least one wall. For example, the housing may be cylindrically shaped with a flange at the bottom of the cylindrical housing. The housing may define an interior volume in which an acoustic fluid may be disposed. Further, the interior volume of the housing may include a mount assembly with a buoy positioned on a first side of the mount assembly and a transducer positioned on a second side of the mount assembly. In some embodiments, the transducer may include a balancing element configured with a material having a desired density. The mount assembly may also include a pivot axle defining a pivot axis about which the mount assembly (and therefore the buoy and the transducer) may be pivotable. Alternatively, the mount assembly may include a gimbal defining a pivot point about which the mount assembly (and therefore the buoy and the transducer) may be pivotable. Thus, in some embodiments, the mount assembly may be pivotable about a pivot axis and have one degree of freedom, or in some other embodiments, the mount assembly may be pivotable about a pivot point and have three degrees of freedom. Further, an orientation of the mount assembly may be subject to a force of gravity, and the housing and the mount assembly may be configured such that an emitting face of the transducer points in a direction that is parallel to the force of gravity when the housing is tilted.

The devices and systems disclosed herein are designed to maintain a downward facing direction of a transducer mounted on or within a watercraft without requiring additional parts or devices and without requiring more actions by the installer. For example, in the past, an installer would have to measure or otherwise determine a hull deadrise of a watercraft and then determine which of a variety of mounting devices to use based on the determined hull deadrise. This required additional time and resources are no longer necessary with the devices and systems of the present disclosure. That is, with the devices and systems of the present disclosure, an installer need not measure or otherwise determine a hull deadrise of a watercraft at all prior to installation. Rather, the installer can proceed with installing the transducer with the devices and/or systems of the present disclosure immediately and the installed transducer will automatically adjust to have and maintain a downward facing orientation with respect to a floor of a body of water underneath the watercraft.

In an example embodiment, a device for mounting a transducer within a hull of a watercraft is provided. The device includes a housing including a base and at least one wall, and the base and the at least one wall define an interior volume. The device also includes a mount assembly disposed within the interior volume of the housing, and the mount assembly includes a buoy positioned on a first side of the mount assembly and a transducer positioned on a second side of the mount assembly. The second side of the mount assembly is opposite from the first side of the mount assembly. The mount assembly also includes a pivot axle defining a pivot axis of the mount assembly, and the mount assembly is freely pivotable about the pivot axis such that an orientation of the mount assembly is subject to a force of gravity. The housing and the mount assembly are configured such that an emitting face of the transducer points in a direction that is parallel to the force of gravity when the housing is tilted.

In some embodiments, the device may further include an acoustic fluid disposed within the interior volume of the housing, and the mount assembly may be positioned at least partially within the acoustic fluid. The mount assembly may be freely pivotable about the pivot axis within the acoustic fluid.

In some embodiments, the housing may be sealed such that the acoustic fluid disposed within the interior volume remains within the interior volume of the housing.

In some embodiments, the acoustic fluid may include at least one of castor oil or glycol.

In some embodiments, the device may further include at least one baffle within the interior volume of the housing that is configured to reduce movement of the acoustic fluid within the interior volume of the housing such that a viscous damping of the acoustic fluid is increased.

In some embodiments, the pivot axis of the mount assembly may be below a center of buoyancy of the buoy.

In some embodiments, the housing may be disposable within a through-hole of a slanted portion of a hull of a watercraft such that the emitting face of the transducer faces a theoretical flat floor of a body of water while the housing is tilted within the slanted portion of the hull.

In some embodiments, the face of the transducer may face the theoretical flat floor of the body of water for any slant angle of the hull.

In some embodiments, the housing may be mounted within the through-hole such that the mount assembly rotates about an axis that is parallel to a pitch axis of the watercraft.

In some embodiments, the mount assembly may be fixed with respect to a roll axis of the watercraft such that disturbances from acceleration changes are avoided.

In some embodiments, the housing may be mounted within the through-hole such that the mount assembly rotates about an axis that is parallel to a roll axis of the watercraft.

In some embodiments, the mount assembly may be fixed with respect to a pitch axis of the watercraft such that disturbances from acceleration changes are avoided.

In some embodiments, the hull may be V-shaped.

In some embodiments, the first side and the second side of the mount assembly may be connected by a moment arm.

In some embodiments, the buoy may exert a buoyant force in a normal direction, and the normal direction may be parallel to the direction that is parallel to the force of gravity. The normal direction may point in an opposite direction than the direction that is parallel to the force of gravity.

In some embodiments, the transducer may include a balancing element.

In some embodiments, the pivot axis of the mount assembly may be above a center of mass of the balancing element.

In some embodiments, the balancing element may be lead zirconate titanate, and the balancing element may have a density of 7600 kg/m3.

In another example embodiment, a system for mounting a transducer within a hull of a watercraft is provided. The system includes a watercraft, and the watercraft includes a hull. The system also includes a housing including a base and at least one wall, and the base and the at least one wall define an interior volume. The system also includes a mount assembly disposed within the interior volume of the housing, and the mount assembly includes a buoy positioned on a first side of the mount assembly and a transducer positioned on a second side of the mount assembly. The second side of the mount assembly is opposite from the first side of the mount assembly. The mount assembly also includes a pivot axle defining a pivot axis of the mount assembly. The mount assembly is freely pivotable about the pivot axis such that an orientation of the mount assembly is subject to a force of gravity, and the housing and the mount assembly are configured such that an emitting face of the transducer points in a direction that is parallel to the force of gravity when the housing is mounted to or within the hull of the watercraft.

In another example embodiment, a device for universal mounting of a transducer is provided. The device includes a housing including a base and at least one wall, and the base and the at least one wall define an interior volume. The device also includes a mount assembly disposed within the interior volume of the housing, and the mount assembly includes a buoy positioned on a first side of the mount assembly and a transducer positioned on a second side of the mount assembly. The second side of the mount assembly is opposite from the first side of the mount assembly. The mount assembly also includes a gimbal defining a pivot point of the mount assembly. The mount assembly is freely pivotable about the pivot point such that an orientation of the mount assembly is subject to a force of gravity, and the housing and the mount assembly are configured such that an emitting face of the transducer points in a direction that is parallel to the force of gravity when the housing is tilted.

In another example embodiment, a device for universal mounting of a transducer is provided. The device includes a housing including a base and at least one wall, and the base and the at least one wall define an interior volume. The base is rounded with a curved inner surface. The device also includes a bearing disposed within the interior volume of the housing, and the bearing includes a rounded outer surface. The bearing includes a buoy positioned on a first side of the bearing and a transducer positioned on a second side of the bearing. The second side of the bearing is opposite from the first side of the bearing. The bearing is freely pivotable about a pivot point by way of the outer surface of the bearing sliding along the inner surface of the base of the housing such that an orientation of the bearing is subject to a force of gravity. The housing and the bearing are configured such that an emitting face of the transducer points in a direction that is parallel to the force of gravity when the housing is tilted.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
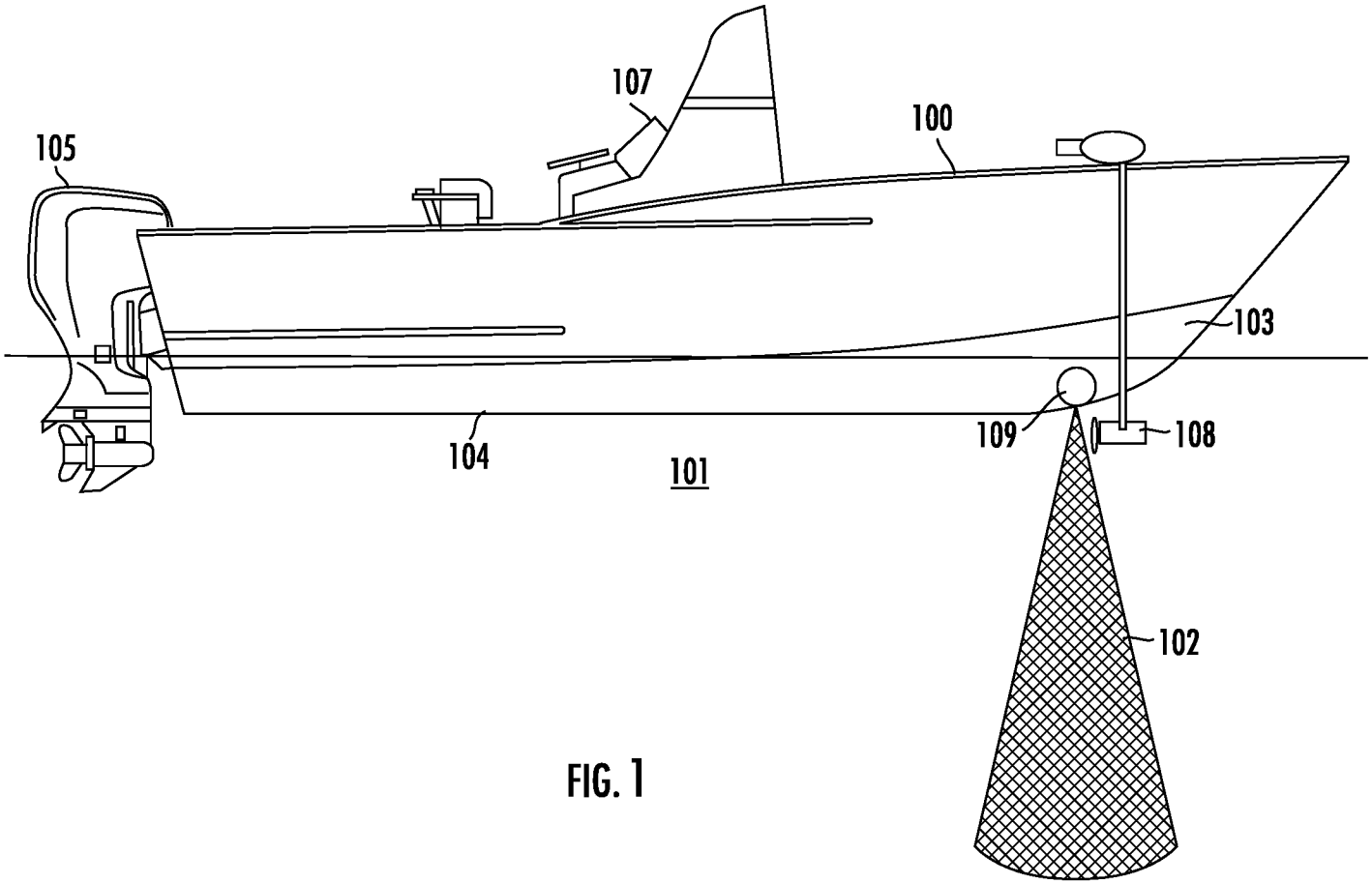
FIG. 1 shows an example watercraft with an example device mounted through a hull of the watercraft, in accordance with some embodiments described herein.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As depicted in FIG. 1, a watercraft 100 (e.g., a vessel) configured to traverse a marine environment, e.g., body of water 101, may have one or more sonar transducers mounted within the hull 103, such as the device 109. As illustrated, the sonar transducer is positioned below the top surface 104 of the body of water 101. The device 109 may include a sonar transducer that emits a beam 102 in a downward direction with respect to the watercraft (despite the hull 103 in which the device 109 is mounted being angled). The watercraft 100 may be a surface watercraft, a submersible watercraft, or any other implementation known to those skilled in the art.

Depending on the configuration, the watercraft 100 may include a main propulsion motor 105, such as an outboard or inboard motor. Additionally, the watercraft 100 may include a trolling motor 108 configured to propel the watercraft 100 or maintain a position. The motor 105 and/or the trolling motor 108 may be steerable using a steering wheel, or in some embodiments, the watercraft 100 may have an autopilot navigation assembly that is operable to steer the motor 105 and/or the trolling motor 108, when engaged. The autopilot navigation assembly may be connected to or within a marine electronic device 107, or it may be located anywhere else on the watercraft 100. Alternatively, it may be located remotely, or in other embodiments, the watercraft 100 may not have an autopilot navigation assembly at all.

The watercraft 100 may also include one or more marine electronic devices 107, such as may be utilized by a user to interact with, view, or otherwise control various aspects of the watercraft and its various marine systems described herein. In the illustrated embodiment, the marine electronic device 107 is positioned proximate the helm (e.g., steering wheel) of the watercraft 100—although other places on the watercraft 100 are contemplated. Likewise, additionally or alternatively, a user's mobile device may include functionality of a marine electronic device.

Figure 2A:
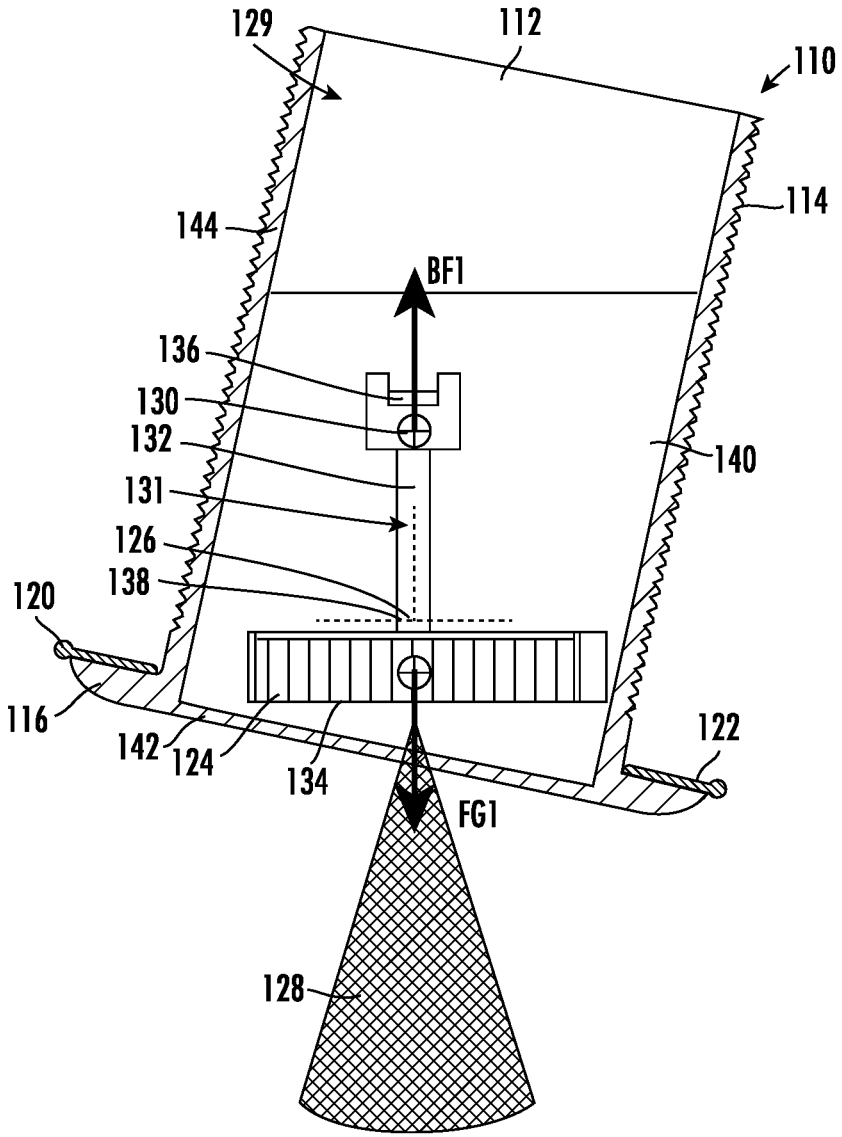
FIG. 2A shows a cross-sectional view of an example device with a pivot axle, in accordance with some embodiments discussed herein.

FIG. 2A shows a cross-sectional view of a device 110 for mounting a transducer 124 within a hull of a watercraft (e.g., within the hull 103 of the watercraft 100 in FIG. 1). The device 110 has a housing 112 made up of a base 142 and a wall 144 extending up from the base 142, and the housing 112 defines an interior volume 129 with the base 142 and the wall 144. It should be appreciated that, in some embodiments, the base 142 and the wall 144 of the housing 112 may take on any shape. For example, although the base 142 and the wall 144 of the housing 112 in FIG. 2A take on a cylindrical shape, in other embodiments, the base 142 and the wall 144 of the housing 112 may be block-like with more walls, may be tapered, or may take on any other form. In some embodiments, the base 142 of the housing 112 extends out into a flange 116, and an outer shell of the wall 144 of the housing 112 includes threads 114. The threads 114 may be configured to interact with threads on a mounting nut or any other mechanism, as will be described in more detail herein.

A mount assembly 131 is mounted within the housing 112, and the mount assembly 131 includes an arm 132 with a first side 136 and a second side 138. The second side 138 may be opposite from the first side 136. In some embodiments, the arm 132 may be a moment arm that connects the first side 136 of the mount assembly 131 and the second side 138 of the mount assembly 131. The arm 132 is rotatable about a pivot axle 126 of the mount assembly 131. The pivot axle 126 defines a pivot axis about which the mount assembly 131 (and, in some embodiments, the arm 132) is rotatable. The arm 132 further includes a buoy 130 positioned on the first side 136 of the mount assembly 131 and a transducer 124 positioned on the second side 138 of the mount assembly 131. The weight of the buoy 130 and the weight of the transducer 124 may be configured to position the arm 132 about the pivot axle 126 such that an emitting face 134 of the transducer 124 remains parallel or substantially parallel with a theoretical flat floor of a body of water beneath the watercraft even when the housing 112 is tilted at an angle with respect to the bottom surface of the body of water. Moreover, the mount assembly 131 may be freely pivotable about the pivot axis created by the pivot axle 126 such that an orientation of the mount assembly 131 is subject to a force of gravity FG1, and the housing 112 and the mount assembly 131 may be configured such that the emitting face 134 of the transducer 124 points in a direction that is parallel to the force of gravity FG1 when the housing 112 is tilted. The pivotability of the mount assembly 131 with respect to the housing 112 may be such that the housing 112 is disposable within a through-hole of a slanted portion of a hull of a watercraft such that the emitting face 134 of the transducer 124 faces the floor of the body of water while the housing 112 is tilted within the slanted portion of the hull. It should be appreciated that the emitting face 134 of the transducer 124 may face the floor of the body of water for any slant angle of the hull.

The transducer 124 may be configured to emit a beam 128 from the emitting face 134 of the transducer 124. The device 110 may thus be configured such that the emitting face 134 points in the direction that is parallel to the force of gravity FG1 when the housing 112 is tilted such that the beam 128 remains in a downward facing direction with respect to the watercraft to maintain a position that enables the transducer 124 to obtain desired imaging beneath the watercraft.

The transducer 124 may have an array of transducer elements that may be utilized with various embodiments of the present disclosure, such as within an example device 110 described herein. In some embodiments, the transducer 124 may include a plurality of transducer elements arranged in a line and electrically connected relative to each other. For example, the transducer elements may be individually positioned on a printed circuit board (PCB). The PCB may mechanically support and electrically connect the electronic components, including the transducer elements using conductive tracks (e.g., traces), pads, and other features. The conductive tracks may comprise sets of traces; for example, each transducer elements may be mounted to the PCB such that the transducer element is in electrical communication with a set of traces. Each transducer element, sub-array, and/or the array of transducer elements may be configured to transmit one or more sonar pulses and/or receive one or more sonar return signals. Unless otherwise stated, although FIG. 2A illustrates a linear array with transducer elements of a certain shape, different types of arrays (or sub-arrays), transducer elements, spacing, shapes, etc. may be utilized with various embodiments of the present disclosure.

In the illustrated embodiment shown in FIG. 2A, the transducer 124 includes the emitting face 134. Within the array, each transducer element defines an emitting face. The length of each transducer element is perpendicular to the length of the emitting face 134. Each transducer element is spaced at a predetermined distance from an adjacent transducer element, which may be designed based on desired operating characteristics of the array, such as described herein.

In some embodiments, the array of transducer elements of the transducer 124 may be configured to operate to transmit one or more sonar beams into the underwater environment. Depending on the configuration and desired operation, different transmission types of sonar beams can occur. For example, in some embodiments, the array may transmit sonar beams according to a frequency sweep (e.g., chirp sonar) so as to provide sonar beams into the underwater environment. In some embodiments, the array may be operated to frequency steer transmitted sonar beams into various volumes of the underwater environment. In some embodiments, the array may be operated to cause a broadband transmit sonar beam to be sent into the underwater environment. Depending on the frequency used and phase shift applied between transducer elements, different volumes of the underwater environment may be targeted.

In some embodiments, the array may be configured to receive sonar return signals. The way the sonar return signals are received and/or processed may vary depending on the desired sonar system configuration. FIG. 2A illustrates the array with an example possible sonar return beam coverage according to various example embodiments (e.g., beam 128). To explain, the sonar returns may be received by the array and filtered into frequency bins based on the frequency of the signal. From that, sonar return beams can be determined that provide sonar returns within a small angle window (e.g., 0.25° to 2°, although greater or lesser angle windows are contemplated). Since the mounting orientation with respect to the watercraft can be known, and the frequency is known, then the relative angle with respect to the waterline (or other reference) can be determined and used to form sonar imagery, as described herein.

The device 110 may be designed to maintain a mounting orientation of the emitting face 134 of the transducer 124 with respect to a watercraft when the device 110 is mounted within a through-hole of a hull (or onto the hull) of the watercraft. Further, the device 110 may be configured to maintain the mounting orientation despite the value of the angle of the hull. For example, as will be described herein, the device 110 may be configured to maintain a generally straight-down mounting orientation of the emitting face 134 of the transducer 124 with respect to the watercraft despite any angle of the hull (and thus despite any angle at which the housing 112 is tilted).

Still referring to FIG. 2A, the buoy 130, which may be positioned on the first side 136 of the mount assembly 131, may exert a buoyant force BF1 in a direction that points upward and/or opposite to the force of gravity FG1 on the transducer 124. Further, the buoy 130 may exert the buoyant force BF1 in a normal direction, the normal direction being parallel to the direction that is parallel to the force of gravity FG1 and pointing in an opposite direction than the direction that is parallel to the force of gravity FG1. The force of gravity FG1 on the transducer 124 and the buoyant force BF1 of the buoy 130 may act together to generate a moment to direct the emitting face 134 of the transducer 124 vertically downwards. Further, the transducer 124 may include a balancing element. For example, the balancing element may be lead zirconate titanate, and/or the balancing element may have a density of 7600 kg/m$^3$. It should be appreciated, however, that the balancing element may include any other material and may have any other density.

In some embodiments, the pivot axis defined by the pivot axle 126 on the mount assembly 131 may be located above a center-of-mass of the balancing element of the transducer 124. Further, in some embodiments, the pivot axis defined by the pivot axle 126 on the mount assembly 131 may be located below a center of buoyancy of the buoy 130. In other embodiments, however, the device 110 may be configured such that the center-of-mass of the transducer 124 is on top of or directly adjacent to the pivot axle 126. Other configurations are also contemplated.

The interior volume 129 of the housing 112 may include an acoustic fluid 140 to facilitate the movement of the transducer 124 and the buoy 130 within the interior volume 129 of the housing 112. The mount assembly 131 may be positioned at least partially within the acoustic fluid 140 such that the mount assembly 131 is freely pivotable about the pivot axis within the acoustic fluid 140. The housing 112 may be sealed such that the acoustic fluid 140 disposed within the interior volume 129 of the housing 112 remains within the interior volume 129 of the housing 112. Moreover, the acoustic fluid 140 may have a desired viscosity such that the transducer 124 and the buoy 130 move about the arm 132 at a desired rate that maintains stability while still enabling the transducer 124 to automatically adjust. For example, the acoustic fluid 140 may include castor oil and/or glycol, among other materials. It should be appreciated that the type of material for the acoustic fluid 140 may have any viscosity. For example, the density of the material of the balancing element within the transducer 124 may be selected based on the viscosity of the of the material of the acoustic fluid 140 (and/or vice versa).

The device 110 shown in FIG. 2A has the pivot axle 126, which defines the pivot axis. The pivot axle 126 enables the arm 132 to rotate about the pivot axis with one degree of freedom (e.g., back and forth). As such, the orientation of the pivot axis with respect to the watercraft into which the device 110 is mounted may be important to a user and/or installer. For example, the housing 112 may be mounted within a through-hole of a watercraft such that the pivot axis is parallel to a pitch axis of the watercraft. Further, the mount assembly 131 may be fixed with respect to a roll axis of the watercraft such that, e.g., disturbances from acceleration changes are avoided. In other embodiments, the housing 112 may be mounted within a through-hole of a watercraft such that the pivot axis is parallel to a roll axis of the watercraft. Further, the mount assembly 131 may be fixed with respect to the pitch axis of the watercraft such that, e.g., disturbances from acceleration changes are avoided.

Because the orientation of the device 110 is related to the functionality of the device 110, the device 110 may include a first marking 120 and a second marking 122 on the flange 116 of the housing 112 to aid an installer in orienting the device 110 in a desired positioning. The first marking 120 and the second marking 122 may correlate to the pivot axis of the pivot axle 126 such that an installer can accurately align the device 110 with respect to a watercraft in a desired position during installation. For example, the first marking 120 and the second marking 122 may together define a line that is perpendicular to the pivot axis. An installer wishing to install the device 110 such that the transducer 124 is moveable along a pitch axis of the watercraft would then need to align the first marking 120 and the second marking 122 such that the line that they together define is parallel to the pitch axis of the watercraft. It should be appreciated that, in other embodiments, the markings may take on any other form or method. For example, the first marking 120 and the second marking 122 may, in some other embodiments, together form a line that is parallel to the pivot axis. Further, more or less markings may be utilized. Other marking configurations are also contemplated.

Figure 2B:
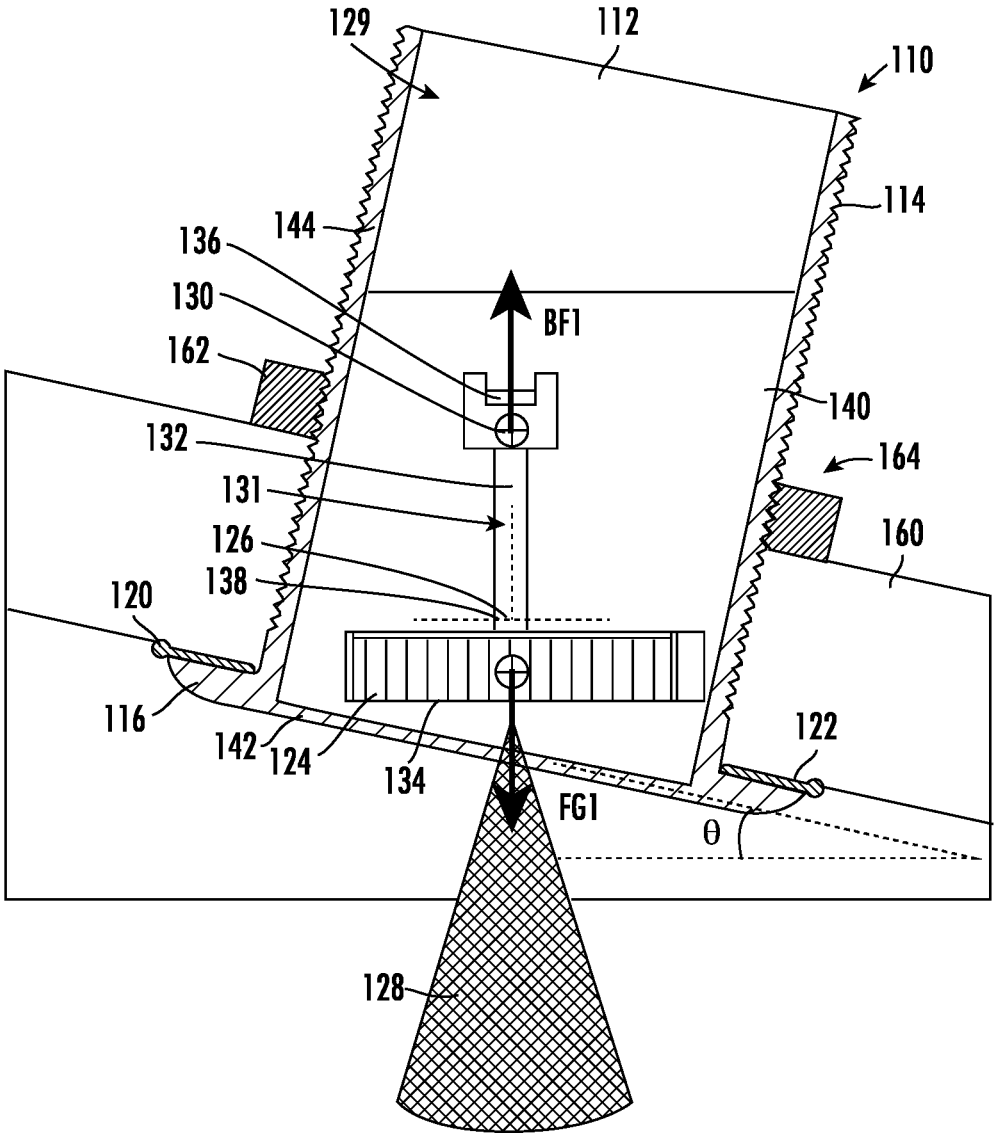
FIG. 2B shows a cross-sectional view of the example device of FIG. 1 mounted within a hull of a watercraft, in accordance with some embodiments discussed herein.

FIG. 2B shows a cross section of the device 110 of FIG. 2A mounted within a through-hole 164 of a hull 160 of a watercraft. In some embodiments, the hull 160 may be V-shaped. In other embodiments, the hull 160 may be rounded, flat, or any other shape. The device 110 is secured within the through-hole 164 by a nut 162 that is twisted around the threads 114 of the wall 144 until it is flush with the hull 160. It should be appreciated that, in other embodiments, the device 110 may be secured within the through-hole 164 in any other way.

Notably, the hull 160 has an angle θ with respect to a floor of a body of water beneath the watercraft. The transducer 124 of the device 110 is configured such that the emitting face 134 of the transducer 124 automatically points in a downward direction for any angle of θ, and further such that the beam 128 of the transducer 124 points in a direction that is generally perpendicular to the floor of the body of water beneath the watercraft.

Figure 3:
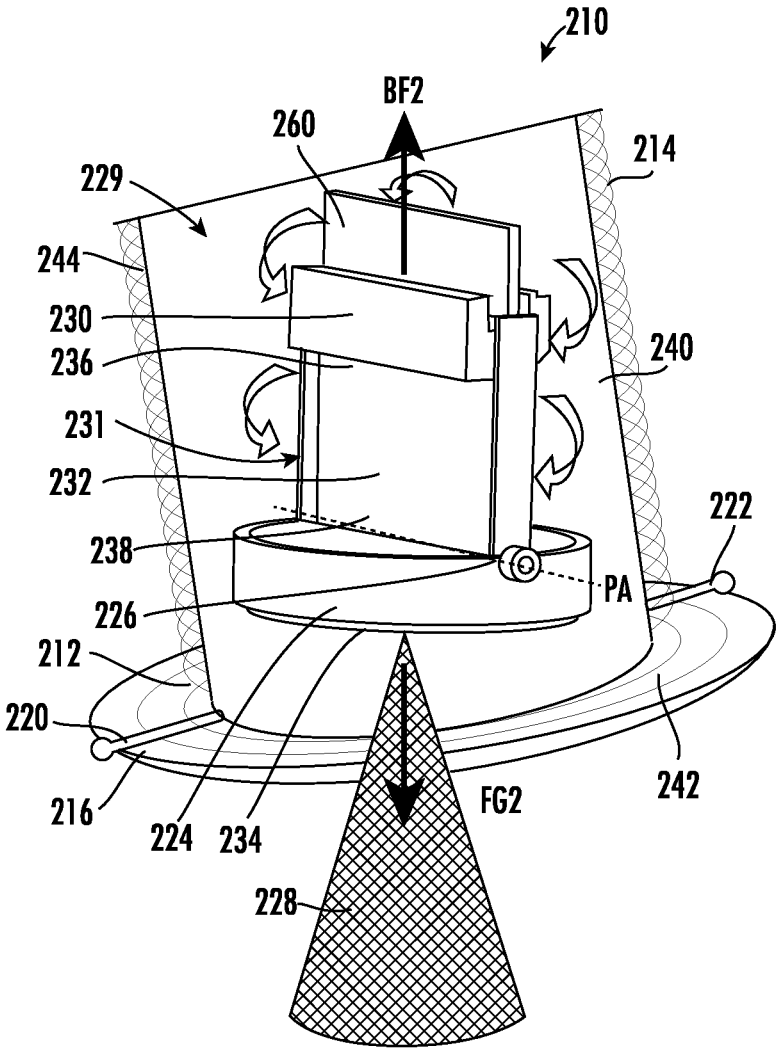
FIG. 3 shows a cross-sectional view of an example device with a pivot axle, the device having a baffle, in accordance with some embodiments discussed herein.

FIG. 3 shows a cross-sectional view of another device 210 for mounting a transducer 224 within a hull of a watercraft (e.g., within the hull 103 of the watercraft 100 in FIG. 1). The device 210 has a housing 212 made up of a base 242 and a wall 244 extending up from the base 242, and the housing 212 defines an interior volume 229 with the base 242 and the wall 244. It should be appreciated that, in some embodiments, the base 242 and the wall 244 of the housing 212 may take on any shape. For example, although the base 242 and the wall 244 of the housing 212 in FIG. 3 take on a cylindrical shape, in other embodiments, the base 242 and the wall 244 of the housing 212 may be block-like with more walls, may be tapered, or may take on any other form. In some embodiments, the base 242 of the housing 212 extends out into a flange 216, and an outer shell of the wall 244 of the housing 212 includes threads 214. The threads 214 may be configured to interact with threads on a mounting nut or any other mechanism.

A mount assembly 231 is mounted within the housing 212, and the mount assembly 231 includes an arm 232 with a first side 236 and a second side 238. The second side 238 may be opposite from the first side 236. In some embodiments, the arm 232 may be a moment arm that connects the first side 236 of the mount assembly 231 and the second side 238 of the mount assembly 231. The arm 232 is rotatable about a pivot axle 226 of the mount assembly 231. The pivot axle 226 defines a pivot axis PA about which the mount assembly 231 (and, in some embodiments, the arm 232) is rotatable. The arm 232 further includes a buoy 230 positioned on the first side 236 of the mount assembly 231 and a transducer 224 positioned on the second side 238 of the mount assembly 231. The weight of the buoy 230 and the weight of the transducer 224 may be configured to position the arm 232 about the pivot axle 226 such that an emitting face 234 of the transducer 224 remains parallel or substantially parallel with a floor of a body of water beneath the watercraft even when the housing 212 is tilted at an angle with respect to the bottom surface of the body of water. Moreover, the mount assembly 231 may be freely pivotable about the pivot axis PA created by the pivot axle 226 such that an orientation of the mount assembly 231 is subject to a force of gravity FG2, and the housing 212 and the mount assembly 231 may be configured such that the emitting face 234 of the transducer 224 points in a direction that is parallel to the force of gravity FG2 when the housing 212 is tilted. The pivotability of the mount assembly 231 with respect to the housing 212 may be such that the housing 212 is disposable within a through-hole of a slanted portion of a hull of a watercraft such that the emitting face 234 of the transducer 224 faces the floor of the body of water while the housing 212 is tilted within the slanted portion of the hull. It should be appreciated that the emitting face 234 of the transducer 224 may face the floor of the body of water for any slant angle of the hull.

The transducer 224 may be configured to emit a beam 228 from the emitting face 234 of the transducer 224. The device 210 may thus be configured such that the emitting face 234 points in the direction that is parallel to the force of gravity FG2 when the housing 212 is tilted such that the beam 228 remains in a downward facing direction with respect to the watercraft to maintain a position that enables the transducer 224 to obtain desired imaging beneath the watercraft.

The transducer 224 may have an array of transducer elements that may be utilized with various embodiments of the present disclosure, such as within an example device 210 described herein. In some embodiments, the transducer 224 may include a plurality of transducer elements arranged in a line and electrically connected relative to each other. For example, the transducer elements may be individually positioned on a printed circuit board (PCB). The PCB may mechanically support and electrically connect the electronic components, including the transducer elements using conductive tracks (e.g., traces), pads, and other features. The conductive tracks may comprise sets of traces; for example, each transducer elements may be mounted to the PCB such that the transducer element is in electrical communication with a set of traces. Each transducer element, sub-array, and/or the array of transducer elements may be configured to transmit one or more sonar pulses and/or receive one or more sonar return signals. Unless otherwise stated, although FIG. 3 illustrates a linear array with transducer elements of a certain shape, different types of arrays (or sub-arrays), transducer elements, spacing, shapes, etc. may be utilized with various embodiments of the present disclosure.

In the illustrated embodiment shown in FIG. 3, the transducer 224 includes the emitting face 234. Within the array, each transducer element defines an emitting face. The length of each transducer element is perpendicular to the length of the emitting face 234. Each transducer element is spaced at a predetermined distance from an adjacent transducer element, which may be designed based on desired operating characteristics of the array, such as described herein.

In some embodiments, the array of transducer elements of the transducer 224 may be configured to operate to transmit one or more sonar beams into the underwater environment. Depending on the configuration and desired operation, different transmission types of sonar beams can occur. For example, in some embodiments, the array may transmit sonar beams according to a frequency sweep (e.g., chirp sonar) so as to provide sonar beams into the underwater environment. In some embodiments, the array may be operated to frequency steer transmitted sonar beams into various volumes of the underwater environment. In some embodiments, the array may be operated to cause a broadband transmit sonar beam to be sent into the underwater environment. Depending on the frequency used and phase shift applied between transducer elements, different volumes of the underwater environment may be targeted.

In some embodiments, the array may be configured to receive sonar return signals. The way the sonar return signals are received and/or processed may vary depending on the desired sonar system configuration. FIG. 3 illustrates the array with an example possible sonar return beam coverage according to various example embodiments (e.g., beam 228). To explain, the sonar returns may be received by the array and filtered into frequency bins based on the frequency of the signal. From that, sonar return beams can be determined that provide sonar returns within a small angle window (e.g., 0.25° to 2°, although greater or lesser angle windows are contemplated). Since the mounting orientation with respect to the watercraft can be known, and the frequency is known, then the relative angle with respect to the waterline (or other reference) can be determined and used to form sonar imagery, as described herein.

The device 210 may be designed to maintain a mounting orientation of the emitting face 234 of the transducer 224 with respect to a watercraft when the device 210 is mounted within a through-hole of a hull (or onto the hull) of the watercraft. Further, the device 210 may be configured to maintain the mounting orientation despite the value of the angle of the hull. For example, as will be described herein, the device 210 may be configured to maintain a generally straight-down mounting orientation of the emitting face 234 of the transducer 224 with respect to the watercraft despite any angle of the hull (and thus despite any angle at which the housing 212 is tilted).

Still referring to FIG. 3, the buoy 230, which may be positioned on the first side 236 of the mount assembly 231, may exert a buoyant force BF2 in a direction that points upward and/or opposite to the force of gravity FG2 on the transducer 224. Further, the buoy 230 may exert the buoyant force BF2 in a normal direction, the normal direction being parallel to the direction that is parallel to the force of gravity FG2 and pointing in an opposite direction than the direction that is parallel to the force of gravity FG2. The force of gravity FG2 on the transducer 224 and the buoyant force BF2 of the buoy 230 may act together to generate a moment to direct the emitting face 234 of the transducer 224 vertically downwards. Further, the transducer 224 may include a balancing element. For example, the balancing element may be lead zirconate titanate, and/or the balancing element may have a density of 7600 kg/m$^3$. It should be appreciated, however, that the balancing element may include any other material and may have any other density.

In some embodiments, the pivot axis PA defined by the pivot axle 226 on the mount assembly 231 may be located above a center-of-mass of the balancing element of the transducer 224. Further, in some embodiments, the pivot axis PA defined by the pivot axle 226 on the mount assembly 231 may be located below a center of buoyancy of the buoy 230. In other embodiments, however, the device 210 may be configured such that the center-of-mass of the transducer 224 is on top of or directly adjacent to the pivot axle 226. Other configurations are also contemplated.

The interior volume 229 of the housing 212 may include an acoustic fluid 240 to facilitate the movement of the transducer 224 and the buoy 230 within the interior volume 229 of the housing 212. The mount assembly 231 may be positioned at least partially within the acoustic fluid 240 such that the mount assembly 231 is freely pivotable about the pivot axis PA within the acoustic fluid 240. The housing 212 may be sealed such that the acoustic fluid 240 disposed within the interior volume 229 of the housing 212 remains within the interior volume 229 of the housing 212. Moreover, the acoustic fluid 240 may have a desired viscosity such that the transducer 224 and the buoy 230 move about the arm 232 at a desired rate that maintains stability while still enabling the transducer 224 to automatically adjust. For example, the acoustic fluid 240 may include castor oil and/or glycol, among other materials. It should be appreciated that the type of material for the acoustic fluid 240 may have any viscosity. For example, the density of the material of the balancing element within the transducer 224 may be selected based on the viscosity of the of the material of the acoustic fluid 240 (and/or vice versa).

The mount assembly 231 may, in some embodiments, include one or more baffles such as the baffle 260. The baffle 260 may be sized and designed based on a viscosity of the acoustic fluid 240 so that the acoustic fluid 240 moves within the interior volume 229 of the housing 212 in a way that optimizes the movement of the transducer 224 when it automatically adjusts to a downward facing orientation. That is, the baffle 260 may act to direct the acoustic fluid 240 within the interior volume 229 of the housing in a desired flow pattern (such as suggested by the arrow around the baffle 260 in FIG. 3). For example, the baffle 260 may be configured to reduce movement of the acoustic fluid 240 within the interior volume 229 of the housing 212 such that a viscous damping of the acoustic fluid 240 is increased. It should be appreciated that, in other embodiments, the baffle 260 may include additional components, may be a different shape, or may not be included at all.

The device 210 shown in FIG. 3 has the pivot axle 226, which defines the pivot axis PA. The pivot axle 226 enables the arm 232 to rotate about the pivot axis PA with one degree of freedom (e.g., back and forth). As such, the orientation of the pivot axis PA with respect to the watercraft into which the device 210 is mounted may be important to a user and/or installer. For example, the housing 212 may be mounted within a through-hole of a watercraft such that the pivot axis PA is parallel to a pitch axis of the watercraft. Further, the mount assembly 231 may be fixed with respect to a roll axis of the watercraft such that, e.g., disturbances from acceleration changes are avoided. In other embodiments, the housing 212 may be mounted within a through-hole of a watercraft such that the pivot axis PA is parallel to a roll axis of the watercraft. Further, the mount assembly 231 may be fixed with respect to a pitch axis of the watercraft such that, e.g., disturbances from acceleration changes are avoided.

Because the orientation of the device 210 is related to the functionality of the device 210, the device 210 may include a first marking 220 and a second marking 222 on the flange 216 of the housing 212 to aid an installer in orienting the device 210 in a desired positioning. The first marking 220 and the second marking 222 may correlate to the pivot axis PA of the pivot axle 226 such that an installer can accurately align the device 210 with respect to a watercraft in a desired position during installation. For example, the first marking 220 and the second marking 222 may together define a line that is perpendicular to the pivot axis PA. An installer wishing to install the device 210 such that the transducer 224 is moveable along a pitch axis of the watercraft would then need to align the first marking 220 and the second marking 222 such that the line that they together define is parallel to the pitch axis of the watercraft. It should be appreciated that, in other embodiments, the markings may take on any other form or method. For example, the first marking 220 and the second marking 222 may, in some other embodiments, together form a line that is parallel to the pivot axis PA. Further, more or less markings may be utilized. Other marking configurations are also contemplated.

Figure 4:
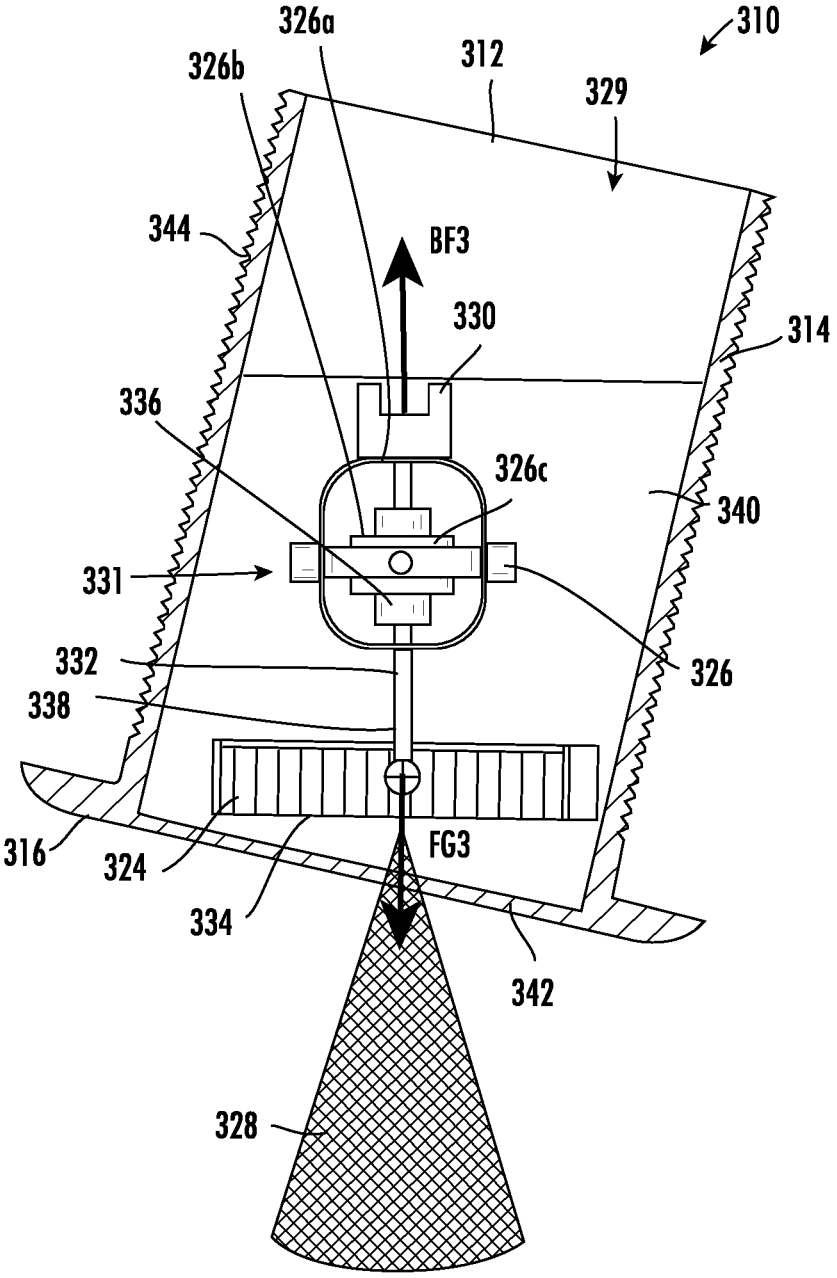
FIG. 4 shows a cross-sectional view of an example device with a gimbal, in accordance with some embodiments discussed herein.

FIG. 4 shows a cross-sectional view of a device 310 for mounting a transducer 324 within a hull of a watercraft (e.g., within the hull 103 of the watercraft 100 in FIG. 1). The device 310 has a housing 312 made up of a base 342 and a wall 344 extending up from the base 342, and the housing 312 defines an interior volume 329 with the base 342 and the wall 344. It should be appreciated that, in some embodiments, the base 342 and the wall 344 of the housing 312 may take on any shape. For example, although the base 342 and the wall 344 of the housing 312 in FIG. 4 take on a cylindrical shape, in other embodiments, the base 342 and the wall 344 of the housing 312 may be block-like with more walls, may be tapered, or may take on any other form. In some embodiments, the base 342 of the housing 312 extends out into a flange 316, and an outer shell of the wall 344 of the housing 312 includes threads 314. The threads 314 may be configured to interact with threads on a mounting nut or any other mechanism.

A mount assembly 331 is mounted within the housing 312, and the mount assembly 331 includes a first side 336 and a second side 338. The second side 338 may be opposite from the first side 336. In some embodiments, a shaft 332 may extend between the first side 336 of the mount assembly 331 and the second side 338 of the mount assembly 331. The mount assembly 331 may be rotatable by way of a gimbal 326 of the mount assembly 331. The gimbal 326 may have a first element 326*a*, a second element 326*b*, and a third element 326*c*. The gimbal 326 may define a pivot point about which the mount assembly 331 (and, in some embodiments, the shaft 332) is rotatable. Each of the first element 326*a*, the second element 326*b*, and the third element 326*c* may be rotatable about the pivot point such that the shaft 332, which may be attached to the third element 326*c*, has three degrees of freedom. Because the transducer 324 is attached to the shaft 332 on the second side 338 of the mount assembly 331, the transducer 324 and the emitting face 334 of the transducer 324 also have three degrees of freedom. The shaft 332 further includes a buoy 330 positioned on the first side 336 of the mount assembly 331. The weight of the buoy 330 and the weight of the transducer 324 may be configured to position the shaft 332 about the pivot point of the gimbal 326 such that an emitting face 334 of the transducer 324 remains parallel or substantially parallel with a floor of a body of water beneath the watercraft even when the housing 312 is tilted at an angle with respect to the bottom surface of the body of water. Moreover, the mount assembly 331 may be freely pivotable about the pivot point created by the gimbal 326 such that an orientation of the mount assembly 331 is subject to a force of gravity FG3, and the housing 312 and the mount assembly 331 may be configured such that the emitting face 334 of the transducer 324 points in a direction that is parallel to the force of gravity FG3 when the housing 312 is tilted. The pivotability of the mount assembly 331 with respect to the housing 312 may be such that the housing 312 is disposable within a through-hole of a slanted portion of a hull of a watercraft such that the emitting face 334 of the transducer 324 faces the floor of the body of water while the housing 312 is tilted within the slanted portion of the hull. It should be appreciated that the emitting face 334 of the transducer 324 may face the floor of the body of water for any slant angle of the hull.

The transducer 324 may be configured to emit a beam 328 from the emitting face 334 of the transducer 324. The device 310 may thus be configured such that the emitting face 334 points in the direction that is parallel to the force of gravity FG3 when the housing 312 is tilted such that the beam 328 remains in a downward facing direction with respect to the watercraft to maintain a position that enables the transducer 324 to obtain desired imaging beneath the watercraft.

The transducer 324 may have an array of transducer elements that may be utilized with various embodiments of the present disclosure, such as within an example device 310 described herein. In some embodiments, the transducer 324 may include a plurality of transducer elements arranged in a line and electrically connected relative to each other. For example, the transducer elements may be individually positioned on a printed circuit board (PCB). The PCB may mechanically support and electrically connect the electronic components, including the transducer elements using conductive tracks (e.g., traces), pads, and other features. The conductive tracks may comprise sets of traces; for example, each transducer elements may be mounted to the PCB such that the transducer element is in electrical communication with a set of traces. Each transducer element, sub-array, and/or the array of transducer elements may be configured to transmit one or more sonar pulses and/or receive one or more sonar return signals. Unless otherwise stated, although FIG. 4 illustrates a linear array with transducer elements of a certain shape, different types of arrays (or sub-arrays), transducer elements, spacing, shapes, etc. may be utilized with various embodiments of the present disclosure.

In the illustrated embodiment shown in FIG. 4, the transducer 324 includes the emitting face 334. Within the array, each transducer element defines an emitting face. The length of each transducer element is perpendicular to the length of the emitting face 334. Each transducer element is spaced at a predetermined distance from an adjacent transducer element, which may be designed based on desired operating characteristics of the array, such as described herein.

In some embodiments, the array of transducer elements of the transducer 324 may be configured to operate to transmit one or more sonar beams into the underwater environment. Depending on the configuration and desired operation, different transmission types of sonar beams can occur. For example, in some embodiments, the array may transmit sonar beams according to a frequency sweep (e.g., chirp sonar) so as to provide sonar beams into the underwater environment. In some embodiments, the array may be operated to frequency steer transmitted sonar beams into various volumes of the underwater environment. In some embodiments, the array may be operated to cause a broadband transmit sonar beam to be sent into the underwater environment. Depending on the frequency used and phase shift applied between transducer elements, different volumes of the underwater environment may be targeted.

In some embodiments, the array may be configured to receive sonar return signals. The way the sonar return signals are received and/or processed may vary depending on the desired sonar system configuration. FIG. 4 illustrates the array with an example possible sonar return beam coverage according to various example embodiments (e.g., beam 328). To explain, the sonar returns may be received by the array and filtered into frequency bins based on the frequency of the signal. From that, sonar return beams can be determined that provide sonar returns within a small angle window (e.g., 0.25° to 2°, although greater or lesser angle windows are contemplated). Since the mounting orientation with respect to the watercraft can be known, and the frequency is known, then the relative angle with respect to the waterline (or other reference) can be determined and used to form sonar imagery, as described herein.

The device 310 may be designed to maintain a mounting orientation of the emitting face 334 of the transducer 324 with respect to a watercraft when the device 310 is mounted within a through-hole of a hull (or onto the hull) of the watercraft. Further, the device 310 may be configured to maintain the mounting orientation despite the value of the angle of the hull. For example, as will be described herein, the device 310 may be configured to maintain a generally straight-down mounting orientation of the emitting face 334 of the transducer 324 with respect to the watercraft despite any angle of the hull (and thus despite any angle at which the housing 312 is tilted).

Still referring to FIG. 4, the buoy 330, which may be positioned on the first side 336 of the mount assembly 331, may exert a buoyant force BF3 in a direction that points upward and/or opposite to the force of gravity FG3 on the transducer 324. Further, the buoy 330 may exert the buoyant force BF3 in a normal direction, the normal direction being parallel to the direction that is parallel to the force of gravity FG3 and pointing in an opposite direction than the direction that is parallel to the force of gravity FG3. The force of gravity FG3 on the transducer 324 and the buoyant force BF3 of the buoy 330 may act together to generate a moment to direct the emitting face 334 of the transducer 324 vertically downwards. Further, the transducer 324 may include a balancing element. For example, the balancing element may be lead zirconate titanate, and/or the balancing element may have a density of 7600 kg/m$^3$. It should be appreciated, however, that the balancing element may include any other material and may have any other density.

In some embodiments, the pivot point defined by the gimbal 326 on the mount assembly 331 may be located above a center-of-mass of the balancing element of the transducer 324. Further, in some embodiments, the pivot point defined by the gimbal 326 on the mount assembly 331 may be located below a center of buoyancy of the buoy 330. In other embodiments, however, the device 310 may be configured such that the center-of-mass of the transducer 324 is on top of or directly adjacent to the gimbal 326. Other configurations are also contemplated.

The interior volume 329 of the housing 312 may include an acoustic fluid 340 to facilitate the movement of the transducer 324 and the buoy 330 within the interior volume 329 of the housing 312. The mount assembly 331 may be positioned at least partially within the acoustic fluid 340 such that the mount assembly 331 is freely pivotable about the pivot point within the acoustic fluid 340. The housing 312 may be sealed such that the acoustic fluid 340 disposed within the interior volume 329 of the housing 312 remains within the interior volume 329 of the housing 312. Moreover, the acoustic fluid 340 may have a desired viscosity such that the transducer 324 and the buoy 330 move about the shaft 332 at a desired rate that maintains stability while still enabling the transducer 324 to automatically adjust. For example, the acoustic fluid 340 may include castor oil and/or glycol, among other materials. It should be appreciated that the type of material for the acoustic fluid 340 may have any viscosity. For example, the density of the material of the balancing element within the transducer 324 may be selected based on the viscosity of the of the material of the acoustic fluid 340 (and/or vice versa).

Although not shown, the mount assembly 331 may, in some embodiments, include one or more baffles. The baffle may be sized and designed based on a viscosity of the acoustic fluid 340 so that the acoustic fluid 340 moves within the interior volume 329 of the housing 312 in a way that optimizes the movement of the transducer 324 when it automatically adjusts to a downward facing orientation. That is, the baffle may act to direct the acoustic fluid 340 within the interior volume 329 of the housing in a desired flow pattern. For example, the baffle may be configured to reduce movement of the acoustic fluid 340 within the interior volume 329 of the housing 312 such that a viscous damping of the acoustic fluid 340 is increased.

The device 310 shown in FIG. 4 has the gimbal 326, which defines the pivot point. The gimbal 326 enables the shaft 332 to rotate about the pivot point with two degrees of freedom. As such, the orientation of the pivot point with respect to the watercraft into which the device 310 is mounted may not be important to a user and/or installer. For example, in contrast to the embodiments discussed herein with respect to FIGS. 2A-3, the two degrees of freedom of the transducer 324 may allow the transducer 324 to automatically adjust no matter the orientation of the housing 312 with respect to the watercraft (e.g., because the mount assembly 331 has a pivot point rather than a pivot axis and because the mount assembly 331 has two degrees of freedom instead of one). Further, the two degrees of freedom of the mount assembly 331 may also avoid disturbances from acceleration changes. For example, even in circumstances in which a large thrust change occurs to the watercraft (e.g., due to a sudden/quick increase in a speed of a motor), which may create a temporary quasi-static error in the dynamic alignment of the device 310, the device 310 may be able to quickly realign to maintain the desired alignment of the emitting face 334 of the transducer 324.

Because the orientation of the device 310 is not related to the functionality of the device 310, the device 310 may not include markings on the flange 316 of the housing 312 to aid an installer in orienting the device 310 in a desired positioning. This is in contrast to the embodiments shown and described with respect to FIGS. 2A-3, which have the first marking 120 and the second marking 122 in FIGS. 2A-2B and the first marking 220 and the second marking 222 in FIG. 3.

Figure 5:
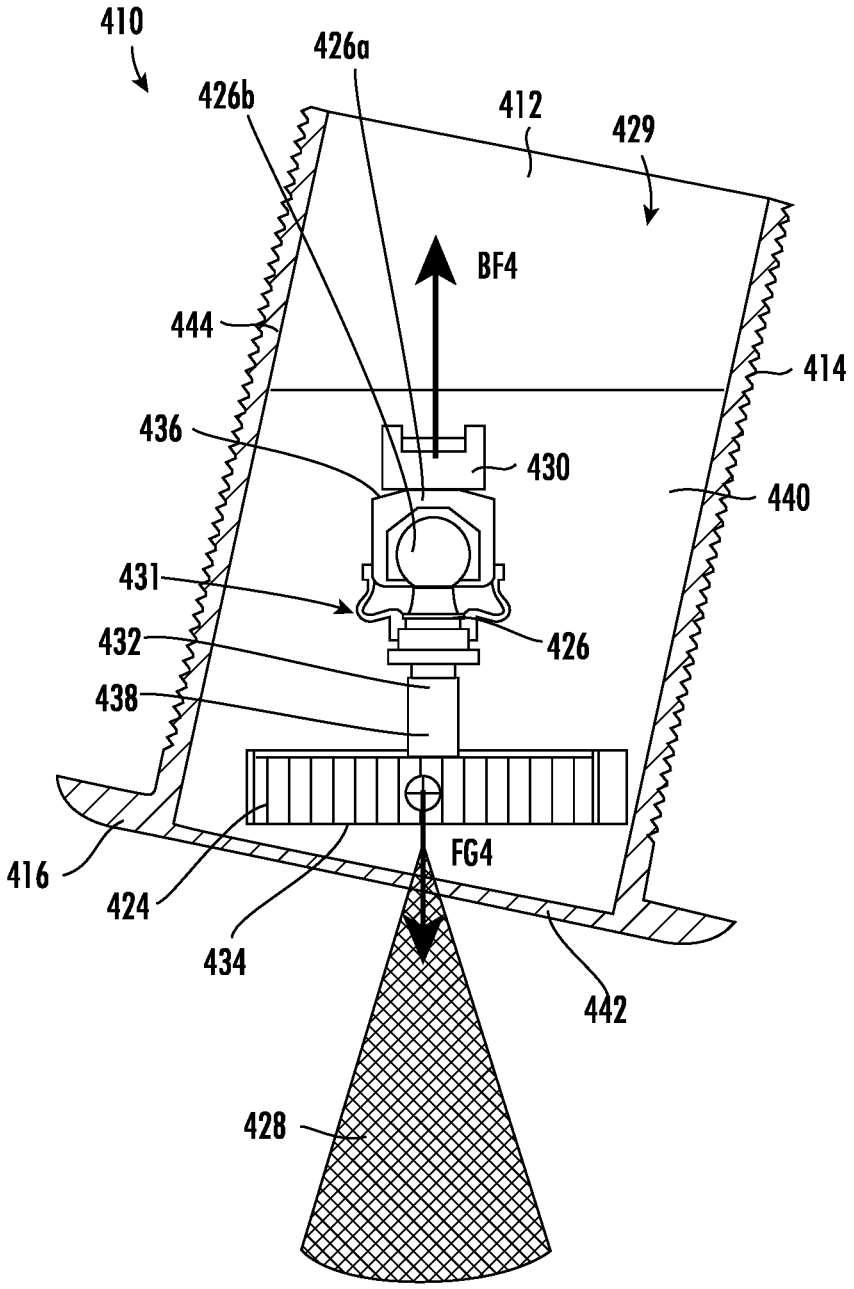
FIG. 5 shows a cross-sectional view of an example device with a ball joint, in accordance with some embodiments discussed herein.

FIG. 5 shows a cross-sectional view of a device 410 for mounting a transducer 424 within a hull of a watercraft (e.g., within the hull 103 of the watercraft 100 in FIG. 1). The device 410 has a housing 412 made up of a base 442 and a wall 444 extending up from the base 442, and the housing 412 defines an interior volume 429 with the base 442 and the wall 444. It should be appreciated that, in some embodiments, the base 442 and the wall 444 of the housing 412 may take on any shape. For example, although the base 442 and the wall 444 of the housing 412 in FIG. 5 take on a cylindrical shape, in other embodiments, the base 442 and the wall 444 of the housing 412 may be block-like with more walls, may be tapered, or may take on any other form. In some embodiments, the base 442 of the housing 412 extends out into a flange 416, and an outer shell of the wall 444 of the housing 412 includes threads 414. The threads 414 may be configured to interact with threads on a mounting nut or any other mechanism.

A mount assembly 431 is mounted within the housing 412, and the mount assembly 431 includes a first side 436 and a second side 438. The second side 438 may be opposite from the first side 436. In some embodiments, a shaft 432 may extend between the first side 436 of the mount assembly 431 and the second side 438 of the mount assembly 431. The mount assembly 431 may be rotatable by way of a ball joint 426 of the mount assembly 431. The ball joint 426 may have a first element 426*a* (e.g., a base) and a second element 426*b* (e.g., a ball). The ball joint 426 may define a pivot point about which the mount assembly 431 (and, in some embodiments, the shaft 432) is rotatable. Each of the first element 426*a* and the second element 426*b* may be rotatable about the pivot point such that the shaft 432, which may be attached to the third element 426*c*, has three degrees of freedom. Because the transducer 424 is attached to the shaft 432 on the second side 438 of the mount assembly 431, the transducer 424 and the emitting face 434 of the transducer 424 also have three degrees of freedom. The shaft 432 further includes a buoy 430 positioned on the first side 436 of the mount assembly 431 (e.g., on or adjacent to the first element 426*a* of the ball joint 426, which may also be movable with respect to the pivot point). The weight of the buoy 430 and the weight of the transducer 424 may be configured to position the shaft 432 about the pivot point of the ball joint 426 such that an emitting face 434 of the transducer 424 remains parallel or substantially parallel with a floor of a body of water beneath the watercraft even when the housing 412 is tilted at an angle with respect to the bottom surface of the body of water. Moreover, the mount assembly 431 may be freely pivotable about the pivot point created by the ball joint 426 such that an orientation of the mount assembly 431 is subject to a force of gravity FG4, and the housing 412 and the mount assembly 431 may be configured such that the emitting face 434 of the transducer 424 points in a direction that is parallel to the force of gravity FG4 when the housing 412 is tilted. The pivotability of the mount assembly 431 with respect to the housing 412 may be such that the housing 412 is disposable within a through-hole of a slanted portion of a hull of a watercraft such that the emitting face 434 of the transducer 424 faces the floor of the body of water while the housing 412 is tilted within the slanted portion of the hull. It should be appreciated that the emitting face 434 of the transducer 424 may face the floor of the body of water for any slant angle of the hull.

The transducer 424 may be configured to emit a beam 428 from the emitting face 434 of the transducer 424. The device 410 may thus be configured such that the emitting face 434 points in the direction that is parallel to the force of gravity FG4 when the housing 412 is tilted such that the beam 428 remains in a downward facing direction with respect to the watercraft to maintain a position that enables the transducer 424 to obtain desired imaging beneath the watercraft.

The transducer 424 may have an array of transducer elements that may be utilized with various embodiments of the present disclosure, such as within an example device 410 described herein. In some embodiments, the transducer 424 may include a plurality of transducer elements arranged in a line and electrically connected relative to each other. For example, the transducer elements may be individually positioned on a printed circuit board (PCB). The PCB may mechanically support and electrically connect the electronic components, including the transducer elements using conductive tracks (e.g., traces), pads, and other features. The conductive tracks may comprise sets of traces; for example, each transducer elements may be mounted to the PCB such that the transducer element is in electrical communication with a set of traces. Each transducer element, sub-array, and/or the array of transducer elements may be configured to transmit one or more sonar pulses and/or receive one or more sonar return signals. Unless otherwise stated, although FIG. 5 illustrates a linear array with transducer elements of a certain shape, different types of arrays (or sub-arrays), transducer elements, spacing, shapes, etc. may be utilized with various embodiments of the present disclosure.

In the illustrated embodiment shown in FIG. 5, the transducer 424 includes the emitting face 434. Within the array, each transducer element defines an emitting face. The length of each transducer element is perpendicular to the length of the emitting face 434. Each transducer element is spaced at a predetermined distance from an adjacent transducer element, which may be designed based on desired operating characteristics of the array, such as described herein.

In some embodiments, the array of transducer elements of the transducer 424 may be configured to operate to transmit one or more sonar beams into the underwater environment. Depending on the configuration and desired operation, different transmission types of sonar beams can occur. For example, in some embodiments, the array may transmit sonar beams according to a frequency sweep (e.g., chirp sonar) so as to provide sonar beams into the underwater environment. In some embodiments, the array may be operated to frequency steer transmitted sonar beams into various volumes of the underwater environment. In some embodiments, the array may be operated to cause a broadband transmit sonar beam to be sent into the underwater environment. Depending on the frequency used and phase shift applied between transducer elements, different volumes of the underwater environment may be targeted.

In some embodiments, the array may be configured to receive sonar return signals. The way the sonar return signals are received and/or processed may vary depending on the desired sonar system configuration. FIG. 5 illustrates the array with an example possible sonar return beam coverage according to various example embodiments (e.g., beam 428). To explain, the sonar returns may be received by the array and filtered into frequency bins based on the frequency of the signal. From that, sonar return beams can be determined that provide sonar returns within a small angle window (e.g., 0.25° to 2°, although greater or lesser angle windows are contemplated). Since the mounting orientation with respect to the watercraft can be known, and the frequency is known, then the relative angle with respect to the waterline (or other reference) can be determined and used to form sonar imagery, as described herein.

The device 410 may be designed to maintain a mounting orientation of the emitting face 434 of the transducer 424 with respect to a watercraft when the device 410 is mounted within a through-hole of a hull (or onto the hull) of the watercraft. Further, the device 410 may be configured to maintain the mounting orientation despite the value of the angle of the hull. For example, as will be described herein, the device 410 may be configured to maintain a generally straight-down mounting orientation of the emitting face 434 of the transducer 424 with respect to the watercraft despite any angle of the hull (and thus despite any angle at which the housing 412 is tilted).

Still referring to FIG. 5, the buoy 430, which may be positioned on the first side 436 of the mount assembly 431, may exert a buoyant force BF4 in a direction that points upward and/or opposite to the force of gravity FG4 on the transducer 424. Further, the buoy 430 may exert the buoyant force BF4 in a normal direction, the normal direction being parallel to the direction that is parallel to the force of gravity FG4 and pointing in an opposite direction than the direction that is parallel to the force of gravity FG4. The force of gravity FG4 on the transducer 424 and the buoyant force BF4 of the buoy 430 may act together to generate a moment to direct the emitting face 434 of the transducer 424 vertically downwards. Further, the transducer 424 may include a balancing element. For example, the balancing element may be lead zirconate titanate, and/or the balancing element may have a density of 7600 $kg/m^3$. It should be appreciated, however, that the balancing element may include any other material and may have any other density.

In some embodiments, the pivot point defined by the ball joint 426 on the mount assembly 431 may be located above a center-of-mass of the balancing element of the transducer 424. Further, in some embodiments, the pivot point defined by the ball joint 426 on the mount assembly 431 may be located below a center of buoyancy of the buoy 430. In other embodiments, however, the device 410 may be configured such that the center-of-mass of the transducer 424 is on top of or directly adjacent to the ball joint 426. Other configurations are also contemplated.

The interior volume 429 of the housing 412 may include an acoustic fluid 440 to facilitate the movement of the transducer 424 and the buoy 430 within the interior volume 429 of the housing 412. The mount assembly 431 may be positioned at least partially within the acoustic fluid 440 such that the mount assembly 431 is freely pivotable about the pivot point within the acoustic fluid 440. The housing 412 may be sealed such that the acoustic fluid 440 disposed within the interior volume 429 of the housing 412 remains within the interior volume 429 of the housing 412. Moreover, the acoustic fluid 440 may have a desired viscosity such that the transducer 424 and the buoy 430 move about the shaft 432 at a desired rate that maintains stability while still enabling the transducer 424 to automatically adjust. For example, the acoustic fluid 440 may include castor oil and/or glycol, among other materials. It should be appreciated that the type of material for the acoustic fluid 440 may have any viscosity. For example, the density of the material of the balancing element within the transducer 424 may be selected based on the viscosity of the of the material of the acoustic fluid 440 (and/or vice versa).

Although not shown, the mount assembly 431 may, in some embodiments, include one or more baffles. The baffle may be sized and designed based on a viscosity of the acoustic fluid 440 so that the acoustic fluid 440 moves within the interior volume 429 of the housing 412 in a way that optimizes the movement of the transducer 424 when it automatically adjusts to a downward facing orientation. That is, the baffle may act to direct the acoustic fluid 440 within the interior volume 429 of the housing in a desired flow pattern. For example, the baffle may be configured to reduce movement of the acoustic fluid 440 within the interior volume 429 of the housing 412 such that a viscous damping of the acoustic fluid 440 is increased.

The device 410 shown in FIG. 5 has the ball joint 426, which defines the pivot point. The ball joint 426 enables the shaft 432 to rotate about the pivot point with two degrees of freedom. As such, the orientation of the pivot point with respect to the watercraft into which the device 410 is mounted may not be important to a user and/or installer. For example, in contrast to the embodiments discussed herein with respect to FIGS. 2A-3, the two degrees of freedom of the transducer 424 may allow the transducer 424 to automatically adjust no matter the orientation of the housing 412 with respect to the watercraft (e.g., because the mount assembly 431 has a pivot point rather than a pivot axis and because the mount assembly 431 has two degrees of freedom instead of one). Further, the two degrees of freedom of the mount assembly 431 may also avoid disturbances from acceleration changes. For example, even in circumstances in which a large thrust change occurs to the watercraft (e.g., due to a sudden/quick increase in a speed of a motor), which may create a temporary quasi-static error in the dynamic alignment of the device 410, the device 410 may be able to quickly realign to maintain the desired alignment of the emitting face 434 of the transducer 424.

Because the orientation of the device 410 is not related to the functionality of the device 410, the device 410 may not include markings on the flange 416 of the housing 412 to aid an installer in orienting the device 410 in a desired positioning. This is in contrast to the embodiments shown and described with respect to FIGS. 2A-3, which have the first marking 120 and the second marking 122 in FIGS. 2A-2B and the first marking 220 and the second marking 222 in FIG. 3.

Figure 6:
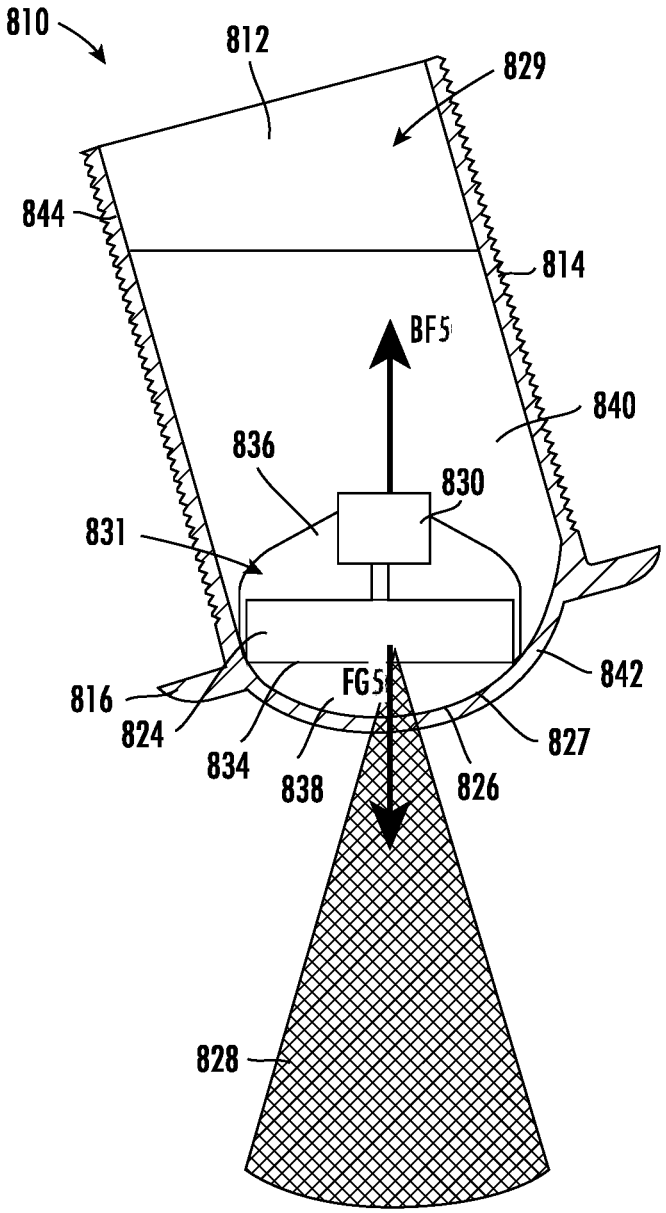
FIG. 6 shows a cross-sectional view of an example device with an ovular bearing configured to slide on a curved base of the device, in accordance with some embodiments discussed herein.

FIG. 6 shows a cross-sectional view of a device 810 for mounting a transducer 824 within a hull of a watercraft (e.g., within the hull 103 of the watercraft 100 in FIG. 1). The device 810 has a housing 812 made up of a base 842 and a wall 844 extending up from the base 842, and the housing 812 defines an interior volume 829 with the base 842 and the wall 844. It should be appreciated that, in some embodiments, the base 842 and the wall 844 of the housing 812 may take on any shape. For example, the wall 844 of the housing 812 in FIG. 6 takes on a cylindrical shape, and the base 842 takes on a curved shape. In other embodiments, the wall 844 and the base 842 of the housing 812 may take on any other form. In some embodiments, the base 842 of the housing 812 extends out into a flange 816, and an outer shell of the wall 844 of the housing 812 includes threads 814. The threads 814 may be configured to interact with threads on a mounting nut or any other mechanism, as described herein.

An ovular bearing 831 is mounted within the housing 812, and the ovular bearing 831 includes a first side 836 and a second side 838. The second side 838 may be opposite from the first side 836. The ovular bearing 831 may be rotatable by way of an outer surface 826 of the ovular bearing 831 sliding along an inner surface 827 of the base 842 of the housing 812. The ovular bearing 831 may define a pivot point about which the ovular bearing 831 is rotatable, and the ovular bearing 831 may have two degrees of freedom. Because the transducer 824 is attached to the second side 838 of the ovular bearing 831, the transducer 824 and the emitting face 834 of the transducer 824 also have two degrees of freedom. The ovular bearing 831 may further include a buoy 830 positioned on the first side 836 of the ovular bearing 831. The weight of the buoy 830 and the weight of the transducer 824 may be configured to position the ovular bearing 831 such that the emitting face 834 of the transducer 824 remains parallel or substantially parallel with a floor of a body of water beneath the watercraft even when the housing 812 is tilted at an angle with respect to the bottom surface of the body of water. Moreover, the ovular bearing 831 may be freely pivotable about the pivot point such that an orientation of the ovular bearing 831 is subject to a force of gravity FG5, and the housing 812 and the ovular bearing 831 may be configured such that the emitting face 834 of the transducer 824 points in a direction that is parallel to the force of gravity FG5 when the housing 812 is tilted. The pivotability of the ovular bearing 831 with respect to the housing 812 may be such that the housing 812 is disposable within a through-hole of a slanted portion of a hull of a watercraft such that the emitting face 834 of the transducer 824 faces the floor of the body of water while the housing 812 is tilted within the slanted portion of the hull. It should be appreciated that the emitting face 834 of the transducer 824 may face the floor of the body of water for any slant angle of the hull.

The transducer 824 may be configured to emit a beam 828 from the emitting face 834 of the transducer 824. The device 810 may thus be configured such that the emitting face 834 points in the direction that is parallel to the force of gravity FG5 when the housing 812 is tilted such that the beam 828 remains in a downward facing direction with respect to the watercraft to maintain a position that enables the transducer 824 to obtain desired imaging beneath the watercraft.

The transducer 824 may have an array of transducer elements that may be utilized with various embodiments of the present disclosure, such as within an example device 810 described herein. In some embodiments, the transducer 824 may include a plurality of transducer elements arranged in a line and electrically connected relative to each other. For example, the transducer elements may be individually positioned on a printed circuit board (PCB). The PCB may mechanically support and electrically connect the electronic components, including the transducer elements using conductive tracks (e.g., traces), pads, and other features. The conductive tracks may comprise sets of traces; for example, each transducer elements may be mounted to the PCB such that the transducer element is in electrical communication with a set of traces. Each transducer element, sub-array, and/or the array of transducer elements may be configured to transmit one or more sonar pulses and/or receive one or more sonar return signals. Unless otherwise stated, although FIG. 6 illustrates a linear array with transducer elements of a certain shape, different types of arrays (or sub-arrays), transducer elements, spacing, shapes, etc. may be utilized with various embodiments of the present disclosure.

In the illustrated embodiment shown in FIG. 6, the transducer 824 includes the emitting face 834. Within the array, each transducer element defines an emitting face. The length of each transducer element is perpendicular to the length of the emitting face 834. Each transducer element is spaced at a predetermined distance from an adjacent transducer element, which may be designed based on desired operating characteristics of the array, such as described herein.

In some embodiments, the array of transducer elements of the transducer 824 may be configured to operate to transmit one or more sonar beams into the underwater environment. Depending on the configuration and desired operation, different transmission types of sonar beams can occur. For example, in some embodiments, the array may transmit sonar beams according to a frequency sweep (e.g., chirp sonar) so as to provide sonar beams into the underwater environment. In some embodiments, the array may be operated to frequency steer transmitted sonar beams into various volumes of the underwater environment. In some embodiments, the array may be operated to cause a broadband transmit sonar beam to be sent into the underwater environment. Depending on the frequency used and phase shift applied between transducer elements, different volumes of the underwater environment may be targeted.

In some embodiments, the array may be configured to receive sonar return signals. The way the sonar return signals are received and/or processed may vary depending on the desired sonar system configuration. FIG. 6 illustrates the array with an example possible sonar return beam coverage according to various example embodiments (e.g., beam 828). To explain, the sonar returns may be received by the array and filtered into frequency bins based on the frequency of the signal. From that, sonar return beams can be determined that provide sonar returns within a small angle window (e.g., 0.25° to 2°, although greater or lesser angle windows are contemplated). Since the mounting orientation with respect to the watercraft can be known, and the frequency is known, then the relative angle with respect to the waterline (or other reference) can be determined and used to form sonar imagery, as described herein.

The device 810 may be designed to maintain a mounting orientation of the emitting face 834 of the transducer 824 with respect to a watercraft when the device 810 is mounted within a through-hole of a hull (or onto the hull) of the watercraft. Further, the device 810 may be configured to maintain the mounting orientation despite the value of the angle of the hull. For example, as will be described herein, the device 810 may be configured to maintain a generally straight-down mounting orientation of the emitting face 834 of the transducer 824 with respect to the watercraft despite any angle of the hull (and thus despite any angle at which the housing 812 is tilted).

Still referring to FIG. 6, the buoy 830, which may be positioned on the first side 836 of the ovular bearing 831, may exert a buoyant force BF5 in a direction that points upward and/or opposite to the force of gravity FG5 on the transducer 824. Further, the buoy 830 may exert the buoyant force BF5 in a normal direction, the normal direction being parallel to the direction that is parallel to the force of gravity FG5 and pointing in an opposite direction than the direction that is parallel to the force of gravity FG5. The force of gravity FG5 on the transducer 824 and the buoyant force BF5 of the buoy 830 may act together to generate a moment to direct the emitting face 834 of the transducer 824 vertically downwards. Further, the transducer 824 may include a balancing element. For example, the balancing element may be lead zirconate titanate, and/or the balancing element may have a density of 7600 kg/m$^3$. It should be appreciated, however, that the balancing element may include any other material and may have any other density.

In some embodiments, the pivot point defined by the ovular bearing 831 may be located above a center-of-mass of the balancing element of the transducer 824. Further, in some embodiments, the pivot point defined by the ovular bearing 831 may be located below a center of buoyancy of the buoy 830. In other embodiments, however, the device 810 may be configured such that the center-of-mass of the transducer 824 is on top of or directly adjacent to the pivot point. Other configurations are also contemplated.

The interior volume 829 of the housing 812 may include an acoustic fluid 840 to facilitate the movement of the transducer 824 and the buoy 830 within the interior volume 829 of the housing 812. The ovular bearing 831 may be positioned at least partially within the acoustic fluid 840 such that the ovular bearing 831 is freely pivotable about the pivot point within the acoustic fluid 840. The housing 812 may be sealed such that the acoustic fluid 840 disposed within the interior volume 829 of the housing 812 remains within the interior volume 829 of the housing 812. Moreover, the acoustic fluid 840 may have a desired viscosity such that the transducer 824 and the buoy 830 move about the pivot point at a desired rate that maintains stability while still enabling the transducer 824 to automatically adjust. For example, the acoustic fluid 840 may include castor oil and/or glycol, among other materials. It should be appreciated that the type of material for the acoustic fluid 840 may have any viscosity. For example, the density of the material of the balancing element within the transducer 824 may be selected based on the viscosity of the of the material of the acoustic fluid 840 (and/or vice versa).

Although not shown, the ovular bearing 831 may, in some embodiments, include or be connected to one or more baffles. The baffle may be sized and designed based on a viscosity of the acoustic fluid 840 so that the acoustic fluid 840 moves within the interior volume 829 of the housing 812 in a way that optimizes the movement of the transducer 824 when it automatically adjusts to a downward facing orientation. That is, the baffle may act to direct the acoustic fluid 840 within the interior volume 829 of the housing in a desired flow pattern. For example, the baffle may be configured to reduce movement of the acoustic fluid 840 within the interior volume 829 of the housing 812 such that a viscous damping of the acoustic fluid 840 is increased.

The device 810 shown in FIG. 6 has the ovular bearing 831, which defines the pivot point. The ovular bearing 831 enables rotation about the pivot point with two degrees of freedom. As such, the orientation of the pivot point with respect to the watercraft into which the device 810 is mounted may not be important to a user and/or installer. For example, in contrast to the embodiments discussed herein with respect to FIGS. 2A-3, the two degrees of freedom of the transducer 824 may allow the transducer 824 to automatically adjust no matter the orientation of the housing 812 with respect to the watercraft (e.g., because the ovular bearing 831 has a pivot point rather than a pivot axis and because the ovular bearing 831 has two degrees of freedom instead of one). Further, the two degrees of freedom of the ovular bearing 831 may also avoid disturbances from acceleration changes. For example, even in circumstances in which a large thrust change occurs to the watercraft (e.g., due to a sudden/quick increase in a speed of a motor), which may create a temporary quasi-static error in the dynamic alignment of the device 810, the device 810 may be able to quickly realign to maintain the desired alignment of the emitting face 834 of the transducer 824.

Because the orientation of the device 810 is not related to the functionality of the device 810, the device 810 may not include markings on the flange 816 of the housing 812 to aid an installer in orienting the device 810 in a desired positioning. This is in contrast to the embodiments shown and described with respect to FIGS. 2A-3, which have the first marking 120 and the second marking 122 in FIGS. 2A-2B and the first marking 220 and the second marking 222 in FIG. 3.

Figure 7:
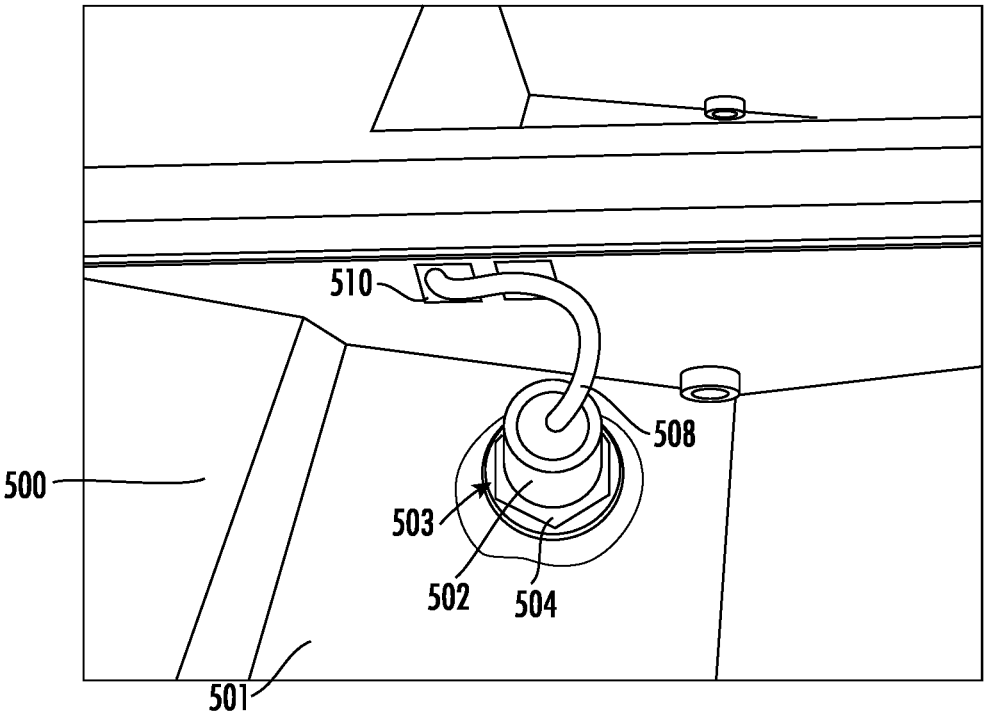
FIG. 7 shows a top view of an example device mounted within a hull of a watercraft, in accordance with some embodiments discussed herein.

FIG. 7 shows a top view of a device 503 mounted through a hull 501 of a watercraft 500. The device 503 includes a housing 502 with threads on an outer surface of the housing 502. A hex nut 504 is twisted around the outer threads of the housing 502 such that the device 503 is secured within the through-hole of the hull 501. The housing 502 is connected to a cable 508 that leads through a hole 510 to another area on the watercraft 500, such as to a marine electronic device or other device containing a processor. As described above with respect to device 110, device 210, device 310, and device 410, the installation process for the device 503 is the same for any angle of the hull 501. It should be appreciated that, in other embodiments, the device 503 may be installed in any other way. For example, the cable 508 may be configured differently and/or the device 503 may be secured by a way other than with the hex nut 504.

Figure 8:
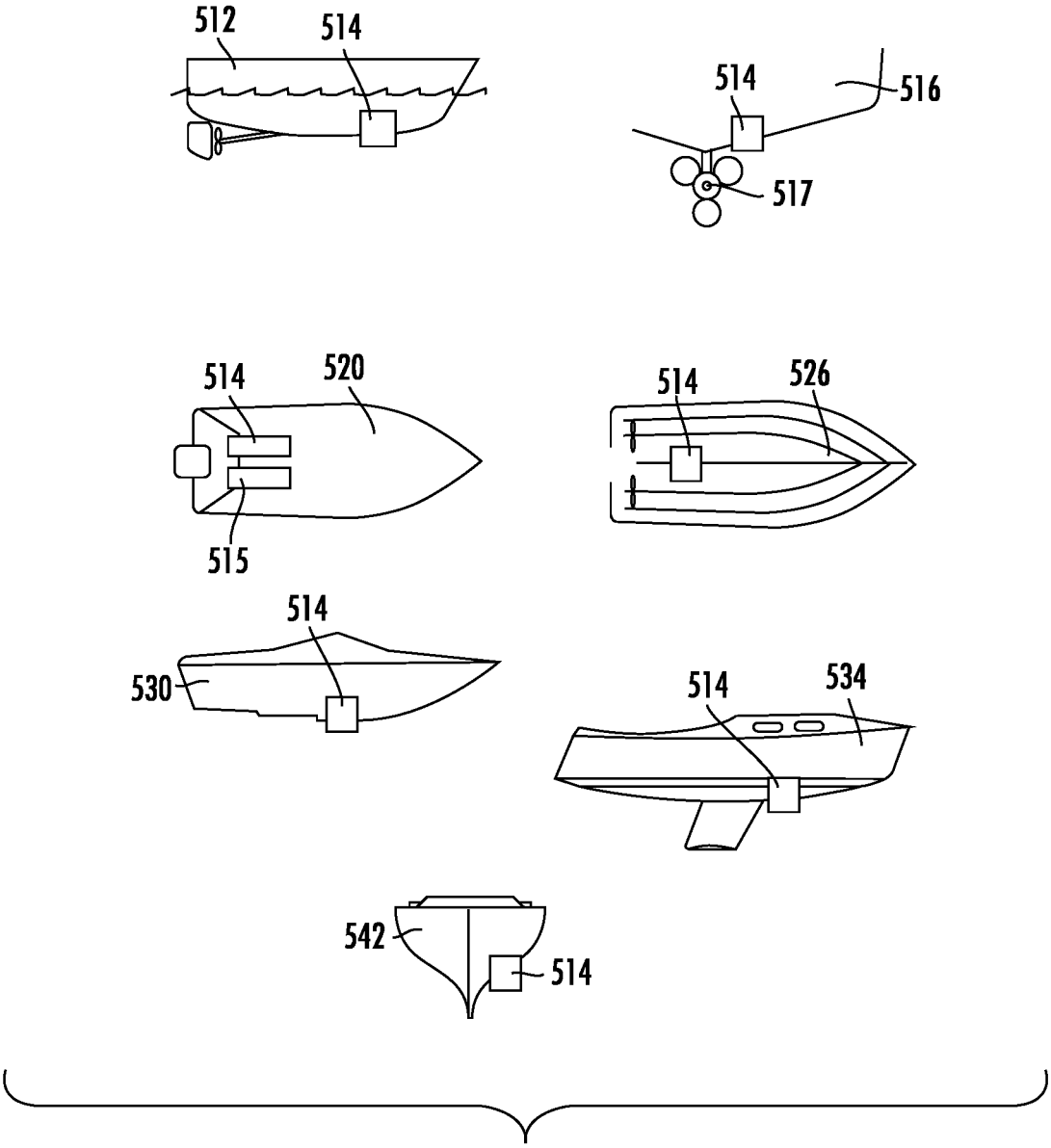
FIG. 8 is a diagram showing multiple positions in which an example device can be mounted with respect to one or more watercraft(s), at varying angles, in accordance with some embodiments discussed herein.

FIG. 8 illustrates various examples of watercrafts on which the devices described herein may be installed. For example, a device 514 may be installed on a front portion of a hull of a watercraft 512, and the hull may have an angle with respect to a floor of a body of water beneath the watercraft 512 that is approximately 2 degrees. The same device 514 may also be mountable to a back portion of a hull of a watercraft 516, which has an angle with respect to a floor of a body of water beneath the watercraft 516 that is approximately 20 degrees. Further, device 514 may also be able to avoid disturbances from the nearby propellor 517 by maintaining a downward facing orientation of a transducer, as described herein.

The same device 514 may also be mountable alongside another device 515 on a back portion of a hull of the watercraft 520. In some embodiments, the device 514 and the device 515 may be similar to the device described herein with respect to FIGS. 2A-2B. In such embodiments, the housing of the device 514 may be mounted such that the mount assembly rotates about an axis that is parallel to a pitch axis of the watercraft 520, and the housing of the device 515 may be mounted such that the mount assembly rotates about an axis that is parallel to a roll axis of the watercraft 520.

The device 514 may also be mountable to a middle portion of a hull of a watercraft 526, which may not be slanted at all. Further, the device 514 may also be mountable within a hull of a watercraft 530, which may have a slant angle that is between 3.5 and 4.5 degrees. The device 514 may further be mountable within a hull of a watercraft 534, which may have a slant angle that is between 1 and 2 degrees. Lastly, the device 514 may also be mountable within a hull of a watercraft 542, which may have a slant angle that is between 30 and 45 degrees.

Notably, in all of the installations of the device 514 in FIG. 8, a downward orientation of the transducer within the device 514 is maintained no matter the slant angle or design of the hull in which the device 514 is installed.

Example System Architecture

Figure 9:
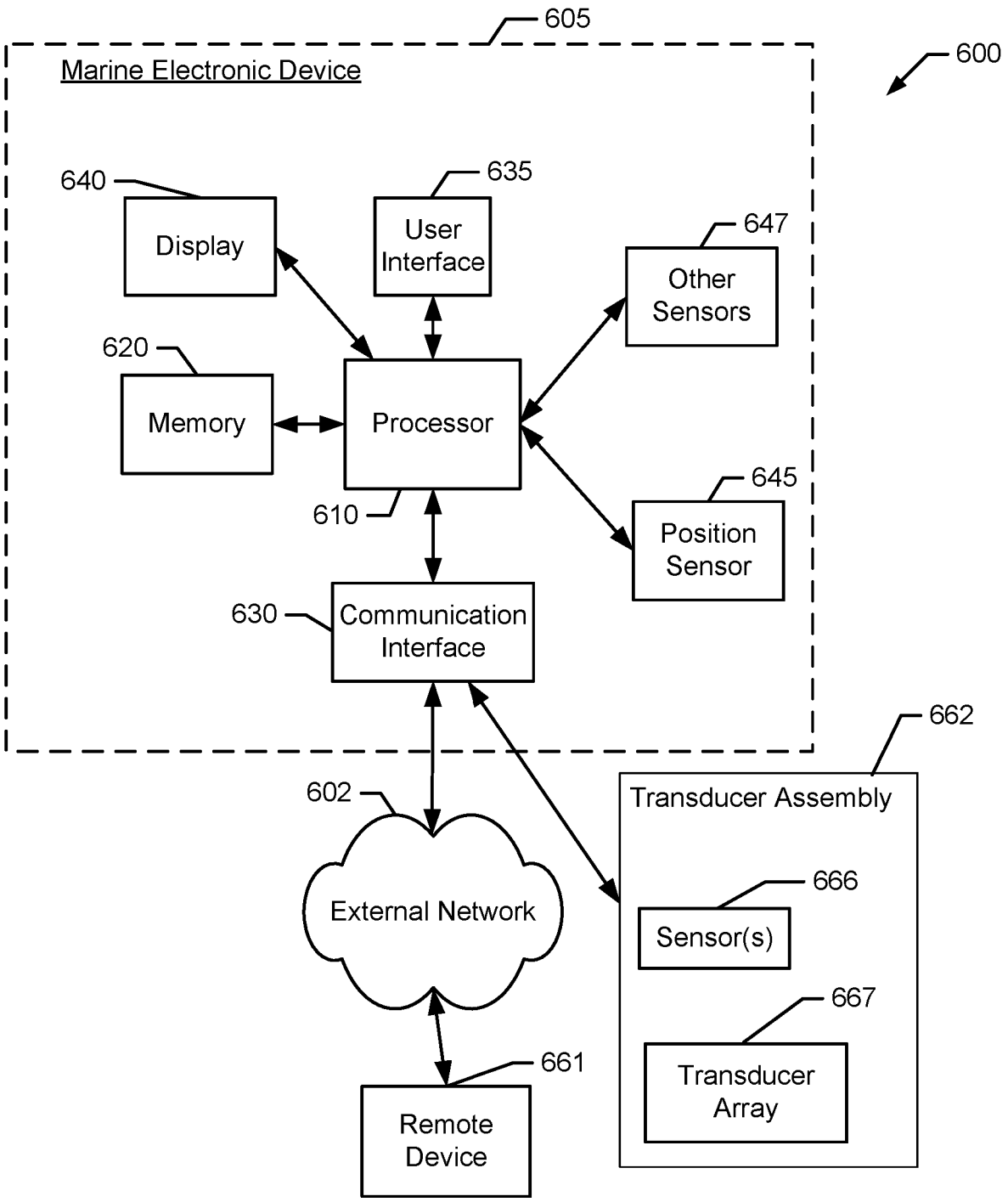
FIG. 9 is a block diagram of an example system, in accordance with some embodiments discussed herein.

FIG. 9 shows a block diagram of an example sonar system 600 of various embodiments described herein. The illustrated sonar system 600 includes a marine electronic device 605 and a transducer assembly 662, although other systems and devices may be included in various example systems described herein. In this regard, the sonar system 600 may include any number of different systems, modules, or components; each of which may comprise any device or means embodied in either hardware, software, or a combination of hardware and software configured to perform one or more corresponding functions described herein.

The marine electronic device 605 may include a processor 610, a memory 620, a user interface 635, a display 640, one or more sensors (e.g., position sensor 645, other sensors 647, etc.), and a communication interface 630. One or more of the components of the marine electronic device 605 may be located within a housing or could be separated into multiple different housings (e.g., be remotely located).

The processor 610 may be any means configured to execute various programmed operations or instructions stored in a memory device (e.g., memory 620) such as a device or circuitry operating in accordance with software or otherwise embodied in hardware or a combination of hardware and software (e.g. a processor operating under software control or the processor embodied as an application specific integrated circuit (ASIC) or field programmable gate array (FPGA) specifically configured to perform the operations described herein, or a combination thereof) thereby configuring the device or circuitry to perform the corresponding functions of the processor 610 as described herein. In this regard, the processor 610 may be configured to analyze electrical signals communicated thereto to provide or receive sonar data, sensor data, location data, and/or additional environmental data. For example, the processor 610 may be configured to receive sonar return data, generate sonar image data, and generate one or more sonar images based on the sonar image data.

In some embodiments, the processor 610 may be further configured to implement sonar signal processing, such as in the form of a sonar signal processor (although in some embodiments, portions of the processor 610 or the sonar signal processor could be located within the transducer assembly 662). In some embodiments, the processor 610 may be configured to perform enhancement features to improve the display characteristics or data or images, collect or process additional data, such as time, temperature, GPS information, waypoint designations, or others, or may filter extraneous data to better analyze the collected data. It may further implement notices and alarms, such as those determined or adjusted by a user, to reflect depth, presence of fish, proximity of other vehicles, e.g., watercraft, etc.

In an example embodiment, the memory 620 may include one or more non-transitory storage or memory devices such as, for example, volatile and/or non-volatile memory that may be either fixed or removable. The memory 620 may be configured to store instructions, computer program code, marine data, such as sonar data, chart data, location/position data, and other data associated with the navigation system in a non-transitory computer readable medium for use, such as by the processor for enabling the marine electronic device 605 to carry out various functions in accordance with example embodiments of the present disclosure. For example, the memory 620 could be configured to buffer input data for processing by the processor 610. Additionally, or alternatively, the memory 620 could be configured to store instructions for execution by the processor 610.

The communication interface 630 may be configured to enable connection to external systems (e.g., an external network 602). In this manner, the marine electronic device 605 may retrieve stored data from a remote device 661 via the external network 602 in addition to or as an alternative to the onboard memory 620. Additionally or alternatively, the marine electronic device may transmit or receive data, such as sonar signals, sonar returns, sonar image data or the like to or from a transducer assembly 662. In some embodiments, the marine electronic device 605 may also be configured to communicate with other devices or systems (such as through the external network 602 or through other communication networks, such as described herein). For example, the marine electronic device 605 may communicate with a propulsion system of the watercraft (e.g., for autopilot control); a remote device (e.g., a user's mobile device, a handheld remote, etc.); or other system.

The marine electronic device 605 may also include one or more communications modules configured to communicate with one another in any of a number of different manners including, for example, via a network. In this regard, the communications module may include any of a number of different communication backbones or frameworks including, for example, Ethernet, the NMEA 2000 framework, GPS, cellular, WiFi, or other suitable networks. The network may also support other data sources, including GPS, autopilot, engine data, compass, radar, etc. In this regard, numerous other peripheral devices (including other marine electronic devices or transducer assemblies) may be included in the system 600.

The position sensor 645 may be configured to determine the current position and/or location of the marine electronic device 605 (and/or the watercraft 100). For example, the position sensor 645 may comprise a global positioning system (GPS), bottom contour, inertial navigation system, such as machined electromagnetic sensor (MEMS), a ring laser gyroscope, or other location detection system.

The display 640, e.g., one or more screens, may be configured to present images and may include or otherwise be in communication with a user interface 635 configured to receive input from a user. The display 640 may be, for example, a conventional LCD (liquid crystal display), a touch screen display, mobile device, or any other suitable display known in the art upon which images may be displayed.

In some embodiments, the display 640 may present one or more sets of marine data (or images generated from the one or more sets of data). Such marine data includes chart data, radar data, weather data, location data, position data, orientation data, sonar data, or any other type of information relevant to the watercraft. In some embodiments, the display 640 may be configured to present such marine data simultaneously as one or more layers or in split-screen mode. In some embodiments, a user may select any of the possible combinations of the marine data for display.

In some further embodiments, various sets of data, referred to above, may be superimposed or overlaid onto one another. For example, a route may be applied to (or overlaid onto) a chart (e.g., a map or navigational chart). Additionally, or alternatively, depth information, weather information, radar information, sonar information, or any other navigation system inputs may be applied to one another.

The user interface 635 may include, for example, a keyboard, keypad, function keys, mouse, scrolling device, input/output ports, touch screen, or any other mechanism by which a user may interface with the system.

Although the display 640 of FIG. 9 is shown as being directly connected to the processor 610 and within the marine electronic device 605, the display 640 could alternatively be remote from the processor 610 and/or marine electronic device 605. Likewise, in some embodiments, the position sensor 645 and/or user interface 635 could be remote from the marine electronic device 605.

The marine electronic device 605 may include one or more other sensors 647 configured to measure or sense various other conditions. The other sensors 647 may include, for example, an air temperature sensor, a water temperature sensor, a current sensor, a light sensor, a wind sensor, a speed sensor, or the like.

The transducer assembly 662 illustrated in FIG. 9 includes a transducer array 667. In some embodiments, more or less transducer arrays could be included, or other transducer elements could be included. As indicated herein, the transducer assembly 662 may also include a sonar signal processor or other processor (although not shown) configured to perform various sonar processing. In some embodiments, the processor (e.g., processor 610 in the marine electronic device 605, a processor (or processor portion) in the transducer assembly 662, or a remote processor—or combinations thereof) may be configured to filter sonar return data and/or selectively control transducer elements of the transducer arrays. For example, various processing devices (e.g., a multiplexer, a spectrum analyzer, A-to-D converter, etc.) may be utilized in controlling or filtering sonar return data and/or transmission of sonar signals from the array 667.

The transducer assembly 662 may also include one or more other systems, such as various sensor(s) 666. For example, the transducer assembly 662 may include an orientation sensor, such as gyroscope or other orientation sensor (e.g., accelerometer, MEMS, etc.) that can be configured to determine the relative orientation of the transducer assembly 662 and/or the array 667—such as with respect to a waterline, the top surface of the body of water, the floor of the body of water, or other reference. In some embodiments, additionally or alternatively, other types of sensor(s) are contemplated, such as, for example, a water temperature sensor, a current sensor, a light sensor, a wind sensor, a speed sensor, or the like.

Example Flowchart

Embodiments of the present disclosure provide methods for manufacturing a device for mounting a transducer within a hull of a watercraft. Various examples of the operations performed in accordance with embodiments of the present disclosure will now be provided with reference to FIG. 10.

Figure 10:
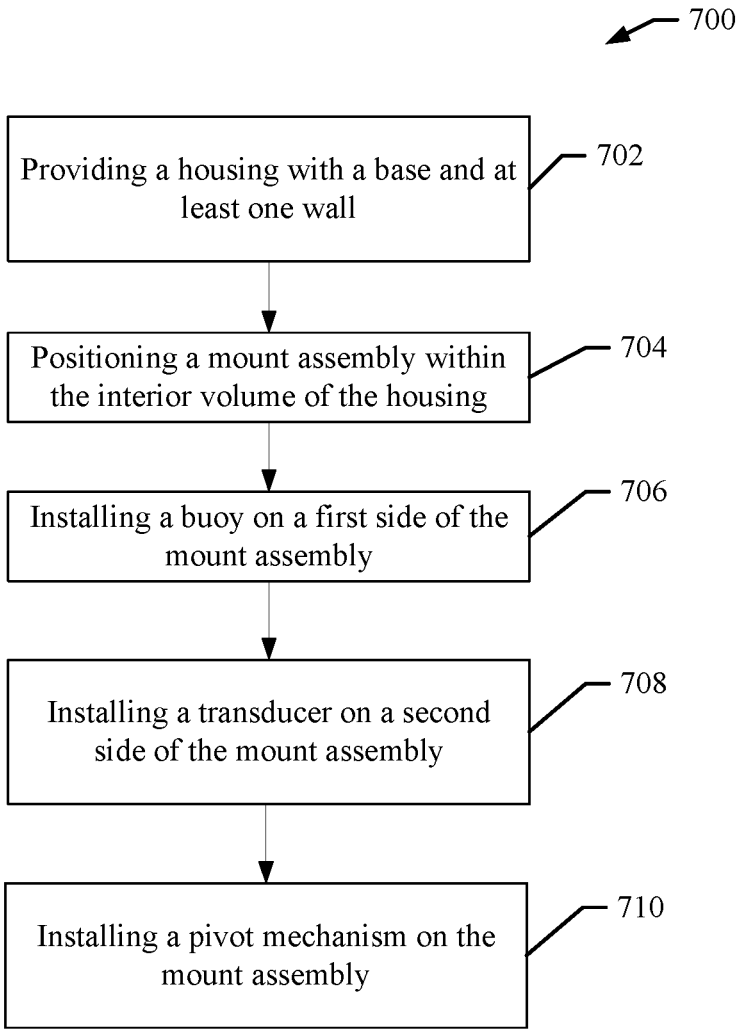
FIG. 10 shows an example method for manufacturing a device, in accordance with some embodiments discussed herein.

FIG. 10 illustrates a flowchart according to an example method 700 for manufacturing a device for mounting a transducer within a hull of a watercraft according to various example embodiments described herein. Operation 702 may include providing a housing with a base and at least one wall. For example, in some embodiments, the base and the at least one wall may define an interior volume, and in some further embodiments, that interior volume may be sealed and comprise an acoustic fluid with a desired viscosity, as described herein. Operation 704 may include positioning a mount assembly within the interior volume of the housing. Operation 706 may include installing a buoy on a first side of the mount assembly. Further, operation 708 may include installing a transducer on a second side of the mount assembly. Operation 710 may include installing a pivot mechanism on the mount assembly. For example, in some embodiments, the pivot mechanism may be a pivot axle as described herein with respect to FIG. 2A-3, or in some other embodiments, the pivot mechanism may be a gimbal or ball joint as described herein with respect to FIGS. 4-5. Other pivot mechanisms are also contemplated. The mount assembly may be freely pivotable about a pivot axis or a pivot point defined by the pivot mechanism such that an orientation of the mount assembly is subject to a force of gravity. Further, the housing and the mount assembly may be configured such that an emitting face of the transducer points in a direction that is parallel to the force of gravity when the housing is tilted.

In some embodiments, the method 700 may include additional, optional operations, and/or the operations described above may be modified or augmented.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A device for mounting a transducer within a hull of a watercraft, the device comprising:

a housing comprising a base and at least one wall, wherein the base and the at least one wall define an interior volume; and a mount assembly disposed within the interior volume of the housing, the mount assembly comprising:

a buoy positioned on a first side of the mount assembly;

a transducer positioned on a second side of the mount assembly, wherein the second side of the mount assembly is opposite from the first side of the mount assembly; and a pivot axle defining a pivot axis of the mount assembly, wherein the mount assembly is freely pivotable about the pivot axis such that an orientation of the mount assembly is subject to a force of gravity, and wherein the housing and the mount assembly are configured such that an emitting face of the transducer points in a direction that is parallel to the force of gravity when the housing is tilted.

2. The device of claim 1, wherein the device further comprises an acoustic fluid disposed within the interior volume of the housing, wherein the mount assembly is positioned at least partially within the acoustic fluid, and wherein the mount assembly is freely pivotable about the pivot axis within the acoustic fluid.

3. The device of claim 2, wherein the housing is sealed such that the acoustic fluid disposed within the interior volume remains within the interior volume of the housing.

4. The device of claim 2, wherein the acoustic fluid comprises at least one of castor oil or glycol.

5. The device of claim 2, wherein the device further comprises at least one baffle within the interior volume of the housing that is configured to reduce movement of the acoustic fluid within the interior volume of the housing such that a viscous damping of the acoustic fluid is increased.

6. The device of claim 2, wherein the pivot axis of the mount assembly is below a center of buoyancy of the buoy.

7. The device of claim 1, wherein the housing is disposable within a through-hole of a slanted portion of a hull of a watercraft such that the emitting face of the transducer faces a theoretical flat floor of a body of water while the housing is tilted within the slanted portion of the hull.

8. The device of claim 7, wherein the face of the transducer faces the theoretical flat floor of the body of water for any slant angle of the hull.

9. The device of claim 7, wherein the housing is mounted within the through-hole such that the mount assembly rotates about an axis that is parallel to a pitch axis of the watercraft.

10. The device of claim 9, wherein the mount assembly is fixed with respect to a roll axis of the watercraft such that disturbances from acceleration changes are avoided.

11. The device of claim 7, wherein the housing is mounted within the through-hole such that the mount assembly rotates about an axis that is parallel to a roll axis of the watercraft.

12. The device of claim 11, wherein the mount assembly is fixed with respect to a pitch axis of the watercraft such that disturbances from acceleration changes are avoided.

13. The device of claim 7, wherein the hull is V-shaped.

14. The device of claim 1, wherein the first side and the second side of the mount assembly are connected by a moment arm.

15. The device of claim 1, wherein the buoy exerts a buoyant force in a normal direction, wherein the normal direction is parallel to the direction that is parallel to the force of gravity, and wherein the normal direction points in an opposite direction than the direction that is parallel to the force of gravity.

16. The device of claim 1, wherein the transducer comprises a balancing element.

17. The device of claim 16, wherein the pivot axis of the mount assembly is above a center of mass of the balancing element.

18. The device of claim 16, wherein the balancing element is lead zirconate titanate, and wherein the balancing element has a density of 7600 $kg/m^3$.

19. A system for mounting a transducer within a hull of a watercraft, the system comprising:

a watercraft, wherein the watercraft comprises a hull;

a housing comprising a base and at least one wall, wherein the base and the at least one wall define an interior volume; and a mount assembly disposed within the interior volume of the housing, the mount assembly comprising:

a buoy positioned on a first side of the mount assembly;

a transducer positioned on a second side of the mount assembly, wherein the second side of the mount assembly is opposite from the first side of the mount assembly; and a pivot axle defining a pivot axis of the mount assembly, wherein the mount assembly is freely pivotable about the pivot axis such that an orientation of the mount assembly is subject to a force of gravity, and wherein the housing and the mount assembly are configured such that an emitting face of the transducer points in a direction that is parallel to the force of gravity when the housing is mounted to or within the hull of the watercraft.

20. A device for universal mounting of a transducer, the device comprising:

a housing comprising a base and at least one wall, wherein the base and the at least one wall define an interior volume; and a mount assembly disposed within the interior volume of the housing, the mount assembly comprising:

a buoy positioned on a first side of the mount assembly;

a transducer positioned on a second side of the mount assembly, wherein the second side of the mount assembly is opposite from the first side of the mount assembly; and a gimbal defining a pivot point of the mount assembly, wherein the mount assembly is freely pivotable about the pivot point such that an orientation of the mount assembly is subject to a force of gravity, and wherein the housing and the mount assembly are configured such that an emitting face of the transducer points in a direction that is parallel to the force of gravity when the housing is tilted.

21. A device for universal mounting of a transducer, the device comprising:

a housing comprising a base and at least one wall, wherein the base and the at least one wall define an interior volume, and wherein the base is rounded with a curved inner surface; and a bearing disposed within the interior volume of the housing, wherein the bearing includes a rounded outer surface, and wherein the bearing comprises:

a buoy positioned on a first side of the bearing; and a transducer positioned on a second side of the bearing, wherein the second side of the bearing is opposite from the first side of the bearing, wherein the bearing is freely pivotable about a pivot point by way of the outer surface of the bearing sliding along the inner surface of the base of the housing such that an orientation of the bearing is subject to a force of gravity, and wherein the housing and the bearing are configured such that an emitting face of the transducer points in a direction that is parallel to the force of gravity when the housing is tilted.

* * * * *